US007503127B2

(12) United States Patent
DuVal et al.

(10) Patent No.: US 7,503,127 B2
(45) Date of Patent: Mar. 17, 2009

(54) ELECTRICALLY CHARGED VOLATILE MATERIAL DELIVERY METHOD

(75) Inventors: Dean Larry DuVal, Lebanon, OH (US); Michael Joseph Orr, West Chester, OH (US); Rafael Trujillo, Mason, OH (US); Angela Renee Troester, Mason, OH (US)

(73) Assignee: The Procter and Gamble Company, Cincinnati, OH (US)

( * ) Notice: Subject to any disclaimer, the term of this patent is extended or adjusted under 35 U.S.C. 154(b) by 343 days.

(21) Appl. No.: 10/762,152

(22) Filed: Jan. 21, 2004

(65) Prior Publication Data

US 2005/0091879 A1 May 5, 2005

Related U.S. Application Data

(63) Continuation-in-part of application No. 10/697,735, filed on Oct. 29, 2003, now Pat. No. 7,146,749, which is a continuation-in-part of application No. 10/697,685, filed on Oct. 26, 2003, now Pat. No. 7,043,855, which is a continuation-in-part of application No. 10/697,734, filed on Oct. 29, 2003, which is a continuation-in-part of application No. 10/697,736, filed on Oct. 29, 2003, now abandoned, which is a continuation-in-part of application No. 10/418,595, filed on Apr. 17, 2003, now Pat. No. 7,059,065.

(60) Provisional application No. 60/374,601, filed on Apr. 22, 2002, provisional application No. 60/426,438, filed on Nov. 14, 2002.

(51) Int. Cl.
*F26B 11/02* (2006.01)

(52) U.S. Cl. ..... 34/381; 34/413

(58) Field of Classification Search ..... 34/381, 34/348, 384, 413
See application file for complete search history.

(56) References Cited

U.S. PATENT DOCUMENTS 2,079,280 A 5/1937 Couch
2,807,893 A 10/1957 Morey (Continued)

FOREIGN PATENT DOCUMENTS

DE 23 18 596 B2 4/1980

(Continued)

OTHER PUBLICATIONS

Brokaw, Leslie—"Get a Whiff Of This", Inc.com Magazine, Nov. 1988 (1 page) Copyright 2003 Gruner + Jahr USA Publishing, Inc. com, 77 North Washington Street, Boston, MA 02114.

(Continued)

*Primary Examiner*—S. Gravini
(74) *Attorney, Agent, or Firm*—Julia A. Glazer; Kim William Zerby; Steven W. Miller

(57) ABSTRACT

The present invention relates to methods of delivering one or more volatile materials, during the operation of a drying apparatus, to a fabric article. The present invention also relates to fabric treatment compositions comprising one or more volatile materials. These compositions may be used to treat fabric articles during the fabric article drying process.

8 Claims, 14 Drawing Sheets

U.S. PATENT DOCUMENTS

| | | | | |
|---|---|---|---|---|
| 2,812,593 | A | 11/1957 | Olthuis | |
| 2,846,776 | A | 8/1958 | Clark | |
| 2,851,791 | A | 9/1958 | Olthuis | |
| 2,873,539 | A | 2/1959 | Morey | |
| 2,941,309 | A | 6/1960 | Cobb | |
| 2,958,954 | A | 11/1960 | Longenecker | |
| 3,002,288 | A | 10/1961 | Conlee | |
| 3,022,580 | A | 2/1962 | Doty | |
| 3,103,450 | A | 9/1963 | Janson | |
| 3,114,653 | A | 12/1963 | Kruzan | |
| 3,172,604 | A | 3/1965 | Brock | |
| 3,180,037 | A | 4/1965 | Etal | |
| 3,239,947 | A | 3/1966 | Etal | |
| 3,267,701 | A | 8/1966 | Mandarino | |
| 3,364,585 | A | 1/1968 | Etal | |
| 3,583,180 | A | 6/1971 | Arbogast | |
| 3,595,036 | A | 7/1971 | Laddle | |
| 3,634,947 | A | 1/1972 | Furgal | |
| 3,816,070 | A | 6/1974 | Candor et al. | |
| 3,872,604 | A | 3/1975 | Keller | |
| 4,009,598 | A | 3/1977 | Bernard et al. | |
| 4,014,105 | A | 3/1977 | Furgal et al. | |
| 4,022,938 | A | 5/1977 | Zaki et al. | |
| 4,098,937 | A | 7/1978 | Mizuno et al. | |
| 4,207,683 | A | 6/1980 | Horton | |
| 4,236,320 | A | 12/1980 | Schwadike et al. | |
| 4,242,377 | A | 12/1980 | Roberts et al. | |
| 4,341,347 | A | 7/1982 | DeVittorio | |
| 4,501,682 | A | 2/1985 | Goodman et al. | |
| 4,511,495 | A | 4/1985 | Melville | |
| 4,532,722 | A | 8/1985 | Sax | |
| 4,567,675 | A | 2/1986 | Rennie | |
| 4,579,279 | A | 4/1986 | Marchant | |
| 4,618,099 | A | 10/1986 | Nagao et al. | |
| 4,642,908 | A | 2/1987 | Brenner | |
| 4,806,254 | A | 2/1989 | Church | |
| 4,891,890 | A | 1/1990 | Church | |
| 5,040,311 | A | 8/1991 | Roy | |
| 5,234,610 | A | 8/1993 | Gardlik et al. | |
| 5,438,773 | A | 8/1995 | Chaffee | |
| 5,442,938 | A | 8/1995 | Kislyuk | |
| 5,445,747 | A | 8/1995 | Kvietok et al. | |
| 5,461,742 | A | 10/1995 | Pasad et al. | |
| 5,595,071 | A | 1/1997 | Pasad et al. | |
| 5,749,163 | A | 5/1998 | Staub et al. | |
| 5,771,604 | A | 6/1998 | Wunderlich et al. | |
| 5,789,368 | A | 8/1998 | You et al. | |
| 5,810,265 | A | 9/1998 | Cornelius et al. | |
| 5,884,418 | A | 3/1999 | McNally | |
| 5,912,408 | A | 6/1999 | Trinh et al. | |
| 5,930,909 | A | 8/1999 | McNally | |
| 5,945,111 | A | 8/1999 | Esser | |
| 5,965,517 | A | 10/1999 | Mooney | |
| 5,966,831 | A | 10/1999 | Anderson | |
| 5,968,404 | A | 10/1999 | Trinh et al. | |
| 5,980,583 | A | 11/1999 | Staub et al. | |
| 5,997,759 | A | 12/1999 | Trinh et al. | |
| 6,001,343 | A | 12/1999 | Trinh et al. | |
| 6,067,723 | A | 5/2000 | Lafrenz | |
| 6,103,678 | A | 8/2000 | Masschelein et al. | |
| 6,160,110 | A | 12/2000 | Thomaides et al. | |
| 6,190,420 | B1 * | 2/2001 | Reynolds | 8/142 |
| 6,220,267 | B1 * | 4/2001 | Joshi | 137/9 |
| 6,277,810 | B2 | 8/2001 | Baines et al. | |
| 6,279,834 | B1 | 8/2001 | Fox et al. | |
| 6,315,800 | B1 | 11/2001 | Gomes et al. | |
| 6,376,455 | B1 | 4/2002 | Friedli et al. | |
| 6,474,563 | B2 | 11/2002 | Pletcher et al. | |
| 6,491,840 | B1 | 12/2002 | Frankenbach et al. | |
| 6,503,413 | B2 | 1/2003 | Uchiyama et al. | |
| 6,571,993 | B2 | 6/2003 | Rodd et al. | |
| 6,574,883 | B2 | 6/2003 | Giblin et al. | |
| 6,604,297 | B2 | 8/2003 | Hagemann et al. | |
| 6,609,311 | B2 | 8/2003 | Hagemann et al. | |
| 6,696,405 | B2 | 2/2004 | Mooney | |
| 6,792,695 | B2 | 9/2004 | Fry et al. | |
| 6,840,069 | B2 * | 1/2005 | France et al. | 68/12.02 |
| 6,883,723 | B2 | 4/2005 | Griese et al. | |
| 6,889,399 | B2 | 5/2005 | Steiner et al. | |
| 2001/0036909 | A1 | 11/2001 | Levinson | |
| 2001/0044399 | A1 | 11/2001 | Keppie et al. | |
| 2001/0052551 | A1 | 12/2001 | Pletcher et al. | |
| 2001/0052552 | A1 | 12/2001 | Hamaguchi et al. | |
| 2002/0050073 | A1 | 5/2002 | Hagemann et al. | |
| 2002/0069465 | A1 | 6/2002 | Chute et al. | |
| 2002/0078589 | A1 | 6/2002 | Hagemann et al. | |
| 2002/0083615 | A1 | 7/2002 | Giblin et al. | |
| 2002/0100122 | A1 | 8/2002 | Rodrigues et al. | |
| 2002/0112293 | A1 | 8/2002 | Trinh et al. | |
| 2003/0035748 | A1 | 2/2003 | Trinh et al. | |
| 2003/0196348 | A1 | 10/2003 | Hagemann et al. | |
| 2003/0199416 | A1 | 10/2003 | Fry et al. | |
| 2003/0199417 | A1 | 10/2003 | Fry et al. | |
| 2003/0200674 | A1 | 10/2003 | Fry et al. | |
| 2003/0213145 | A1 | 11/2003 | Hagemann et al. | |
| 2003/0224965 | A1 | 12/2003 | Conley et al. | |
| 2004/0064970 | A1 | 4/2004 | Hagemann et al. | |
| 2004/0118014 | A1 | 6/2004 | Burgess et al. | |
| 2004/0134094 | A1 | 7/2004 | Hahn et al. | |
| 2004/0221476 | A1 | 11/2004 | Jones et al. | |
| 2004/0253376 | A1 | 12/2004 | Parker | |
| 2005/0020478 | A1 | 1/2005 | Cooke et al. | |

FOREIGN PATENT DOCUMENTS

| | | | |
|---|---|---|---|
| EP | 0 130 682 | | 1/1985 |
| EP | 0 118 313 | | 5/1987 |
| EP | 0 315 879 | B1 | 5/1989 |
| EP | 0 204 484 | B1 | 3/1992 |
| EP | 0 594 154 | A1 | 4/1994 |
| EP | 0 848 999 | A2 | 6/1998 |
| EP | 0 676 497 | B1 | 9/1999 |
| EP | 0 953 669 | A2 | 11/1999 |
| EP | 1 479 757 | A1 | 11/2004 |
| GB | 2 066 309 | A | 7/1981 |
| GB | 2 231 944 | A | 11/1990 |
| GB | 2 354 006 | B | 3/2001 |
| GB | 2 366 568 | A | 3/2002 |
| GB | 2 346 678 | B | 10/2002 |
| JP | 02-302300 | | 12/1990 |
| JP | 06-015090 | | 1/1994 |
| JP | 1995068094 | A2 | 3/1995 |
| JP | 08-150293 | | 6/1996 |
| JP | 1996215488 | A | 8/1996 |
| JP | 09-267000 | A | 10/1997 |
| JP | 10-290898 | A | 11/1998 |
| JP | 2002069832 | A2 | 3/2002 |
| JP | 2002115182 | A | 4/2002 |
| WO | WO 96/09430 | | 3/1996 |
| WO | WO 99/55952 | A1 | 11/1999 |
| WO | WO 99/55953 | A1 | 11/1999 |
| WO | WO 00/01421 | A1 | 1/2000 |
| WO | WO 00/01422 | A1 | 1/2000 |
| WO | WO 00/01493 | A1 | 1/2000 |
| WO | WO 00/11133 | | 3/2000 |
| WO | WO 00/24851 | A2 | 5/2000 |
| WO | WO 00/24856 | A1 | 5/2000 |
| WO | WO 00/24858 | A1 | 5/2000 |
| WO | WO 00/38512 | A1 | 7/2000 |
| WO | WO 00/55292 | | 9/2000 |
| WO | WO 00/58428 | | 10/2000 |
| WO | WO 01/07710 | A1 | 2/2001 |
| WO | WO 01/18145 | A2 | 3/2001 |
| WO | WO 01/66264 | A1 | 9/2001 |

| | | | |
|---|---|---|---|
| WO | WO 02/08510 | A1 | 1/2002 |
| WO | WO 02/12423 | A2 | 2/2002 |
| WO | WO 02/33161 | A1 | 4/2002 |
| WO | WO 02/40623 | A2 | 5/2002 |
| WO | WO 03/004170 | A1 | 1/2003 |
| WO | WO 03/008528 | A1 | 1/2003 |
| WO | WO 03/087286 | A1 | 10/2003 |
| WO | WO 03/087461 | A1 | 10/2003 |
| WO | WO 03/102289 | A1 | 12/2003 |
| WO | WO 2004/099489 | A2 | 11/2004 |

OTHER PUBLICATIONS

StainsFile—"Classification of Dyes"; "Direct Dyes"; "Acid Dyes"; Comparison of Dye Structure; "Structure and Colour in Dyes"; (16 pages). Internet Website http://members.pgonline.com/~bryand/StainsFile/dyes/class/dyeclass.htm, Nov. 2002.

Innovative Packaging Network—"Clean-Clic®" (1 page). Internet Website www.ipneurope.com/Componentright1.html.

Medlin, Jennifer—"Microban, Germ Warfare", Environmental Health Perspectives v.105, n.3, Mar. 1997 (5 pages). Internet Website www.mindfully.org/Plastic/Microban-Germ-Warfare.htm.

Exair-Mail Newsletter—Winter 2002-2003 (2 pages). Exair Corporation, 1250 Century Circle North, Cincinnati, Ohio, 45246-3309.

Fyffe, Matt—Technical Report—"Recent Developments in Long-Range Static Elimination", Jun. 2003 (3 pages). Meech Static Eliminators, USA, Richfield, Ohio, Internet Website www.meech.com.

Quantum Research Group "Capacitance Explained" printed Nov. 18, 2004 (3 pages). Internet Website www.qprox.com/background/capacitance.php.

International Critical Tables of Numerical Data, Physics, Chemistry and Technology, National Research Council of the United States of America, Edward W. Washburn, editor in chief, first electronic edition, published by Knovel, Norwich, New York, 2003, pp. 148-162.

Handbook of Chemistry and Physics, 3rd electronic edition, following the 81st printed edition, David R. Lide, editor-in-chief, published by CRC Press, Inc. 2000, Boca Raton, Florida, pp. 5-102 to 5-103, 5-4 to 5-88.

Perry's Chemical Engineer's Handbook, seventh edition, following the 81st printed edition, published by McGraw-Hill, ISBN 0-07-049841-5, 1997, pp. 2-187 to 2-195.

U.S. Appl. No. 11/407,418, filed Apr. 20, 2006, Inventors Gerlach et al.

U.S. Appl. No. 11/592,359, filed Nov. 2006, Inventors Barron et al.

U.S. Appl. No. 11/386,952, filed Mar. 22, 2006, Inventors Heilman et al.

U.S. Appl. No. 11/344,314, filed Jan. 31, 2006, Inventors Zhang et al.

U.S. Appl. No. 11/171,102, filed Jun. 30, 2005, Inventors France et al.

U.S. Appl. No. 11/171,100, filed Jun. 30, 2005, Inventors France et al.

U.S. Appl. No. 11/171,101, filed Jun. 30, 2005, Inventors Clark et al.

* cited by examiner

ELECTRICALLY CHARGED VOLATILE MATERIAL DELIVERY METHOD

CROSS REFERENCE TO RELATED APPLICATIONS

This application is a continuation-in-part of U.S. Ser. No. 10/697,735, filed Oct. 29, 2003, U.S. Ser. No. 10/697,685, filed Oct. 29, 2003, U.S. Ser. No. 10/697,734 filed Oct. 29, 2003, and U.S. Ser. No. 10/697,736 filed Oct. 29, 2003; each of which is a continuation-in-part of U.S. Ser. No. 10/418,595, filed Apr. 17, 2003; which claims the benefit of U.S. Provisional Application Ser. No. 60/374,601, filed Apr. 22, 2002; and U.S. Provisional Application Ser. No. 60/426,438, filed Nov. 14, 2002.

FIELD OF INVENTION

The present invention relates to methods and compositions useful for delivering volatile materials to a fabric article.

BACKGROUND OF THE INVENTION

Volatile materials, such as certain perfume materials, are required to produce certain highly desired scents or provide certain fabric benefits. Unfortunately the benefit of such volatile materials is not obtained when applied during the operation of application devices such as clothing dryers, as such materials and compositions are unevenly deposited, and/or vaporized and expelled from the dryer before the end of the drying cycle.

Accordingly, there is a need for a convenient and effective method of delivering such materials and compositions comprising such materials.

SUMMARY OF THE INVENTION

The present invention relates to a method of delivering a material, during the operation of an application device, to a fabric article contained in said device, said method comprising the step of applying said material to said fabric article during the operation of said application device.

The present invention also relates to treatment compositions comprising a perfume material.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE INVENTION

Definitions

Figure 1:
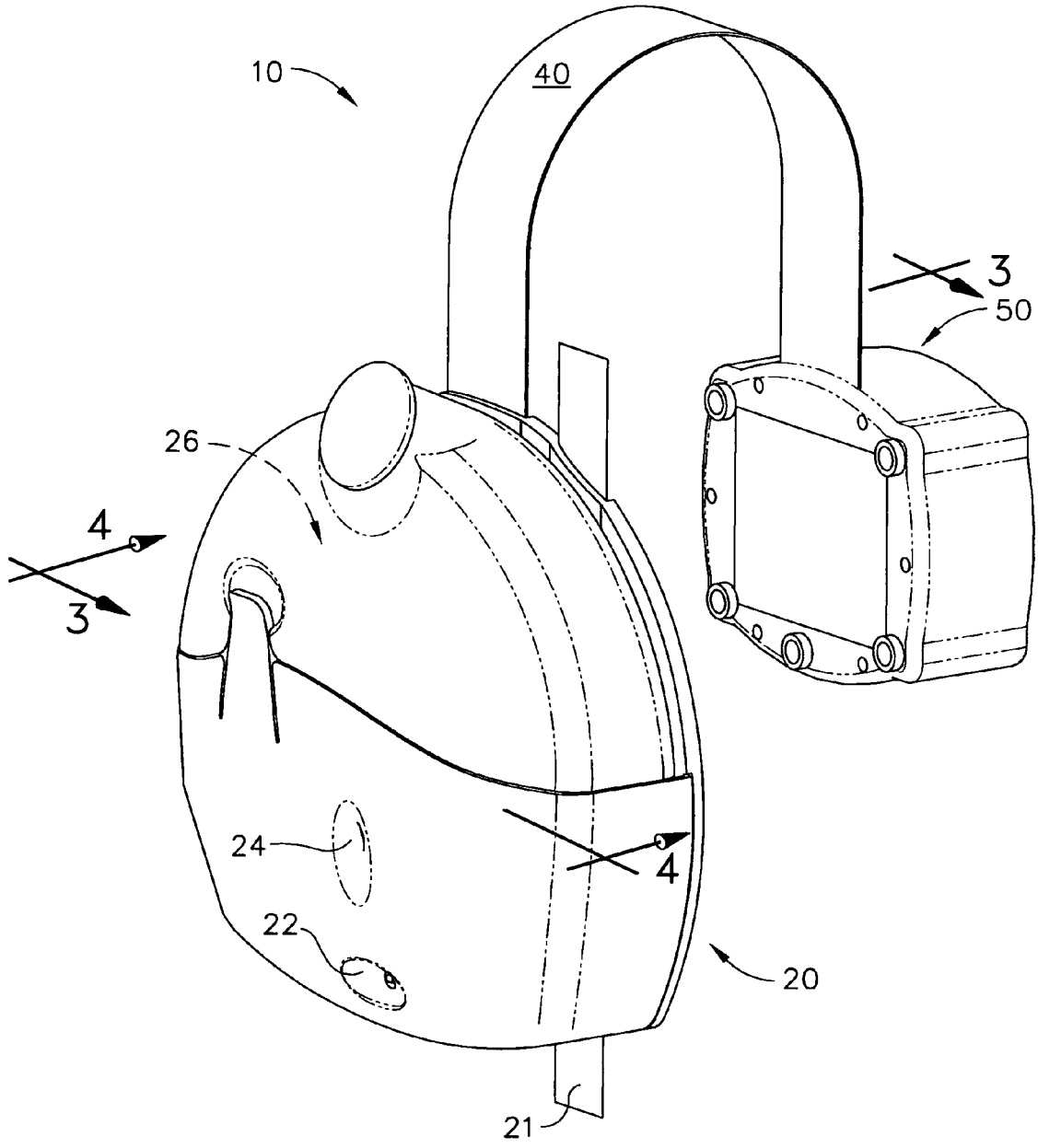
FIG. 1 is a perspective view of an embodiment for a stand-alone fabric article treating apparatus that is constructed according to the principles of the present invention.

As used herein, "fabric article" means an article that comprises a fabric. Such articles include, but are not limited to, clothing, shoes, curtains, towels, linens, upholstery coverings and cleaning implements.

As used herein, "during a dryer cycle" means while the dryer is operating.

As used herein, "treatment material" means a material or combination of materials that can deliver one or more of the following benefits to a fabric article; softening, crispness, water and/or stain repellency, refreshing, antistatic, anti-shrinkage, anti-microbial, durable press, wrinkle resistance, odor resistance, abrasion resistance, anti-felting, anti-pilling, appearance enhancement, and mixtures thereof.

As used herein, "fabric treatment composition" means a composition that comprises one or more treatment materials, or one or more perfume materials, or combinations thereof. Suitable forms of treatment compositions include, but are not limited to, fluidic substances, such as liquids or gases, and solid compounds, such particles or powders.

As used herein, the terms "treatment composition", "fabric treatment composition" and "benefit composition" are synonymous.

As used herein, "perfume" means a mixture of perfume materials.

As used herein, the articles "a" and "an", when used in a claim, are understood to mean one or more of the material that is claimed or described.

For the purposes of the surfactants described herein, it should be understood that the terms "alkyl" or "alkenyl" include mixtures of radicals that can contain one or more intermediate linkages such as ether or polyether linkages or non-functional substituents such as hydroxyl or halogen radicals wherein the radical remains of hydrophobic character.

Unless otherwise noted, all component or composition levels are in reference to the active level of that component or composition, and are exclusive of impurities, for example, residual solvents or by-products, which may be present in commercially available sources.

Unless otherwise indicated, all percentages and ratios are calculated based on weight of the total composition.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited are, in relevant part, incorporated herein by reference; the citation of any document is not to be construed as an admission that it is prior art with respect to the present invention.

Delivery Method

Applicants' delivery method comprises the steps of monitoring an operating temperature of a drying apparatus during a drying cycle of said drying apparatus and applying a fabric treatment composition to a fabric article during said drying cycle of said drying apparatus, said application occurring after said drying apparatus has reached a first control operating temperature. For example, said first control operating temperature may be a predetermined temperature that is entered by a user, or is set by a computing device in the system controller. In that instance, the predetermined temperature (as the first control operating temperature) could be set equal to or higher than 60° C., or even equal to or higher than 70° C.

Alternatively, the first control operating temperature may be a maximum operating temperature, in which the system controller repetitively or continuously samples or measures the actual operating temperature until it determines that a maximum operating temperature has been achieved; typically, this determination would be made by observing that the actual temperature has begun falling during operation of the drying apparatus. Said maximum operating temperature (as a physical temperature in degrees C. or F.) need not be specified or predetermined by the system controller, but can be virtually any suitable temperature that the drying apparatus is capable of producing in its normal operation. As such, the maximum operating temperature may typically fall within a range such that it is equal to or higher than 60° C, or perhaps equal to or higher than 70° C.

In another aspect of Applicants' invention, said invention comprises the steps of monitoring an operating temperature of a drying apparatus during a drying cycle of said drying apparatus; and applying a fabric treatment composition to a fabric article after said drying apparatus has reached a first maximum operating temperature (e.g., as a control operating temperature) and then returned to a second, lower operating temperature. Said first maximum operating temperature may be about 60° C. or higher and said second operating temperature may be less than about 60° C. Alternatively, said first maximum operating temperature may be about 70° C. or higher and said second operating temperature may be less than about 70° C.

In another aspect of Applicants' invention, said invention comprises the steps of monitoring an operating temperature of a drying apparatus during a drying cycle of said drying apparatus; and applying a fabric treatment composition to a fabric article after said drying apparatus has reached a first maximum operating temperature (e.g., as a control operating temperature) and then returned to a second operating temperature, but before a third operating temperature is reached. Said first maximum operating temperature may be about 70° C. or higher, said second operating temperature may be less than about 70° C. and said third operating temperature may be greater than about 20° C. Alternatively, said first maximum operating temperature may be 60° C. or higher, said second operating temperature may be less than about 60° C., and said third operating temperature may be greater than about 25° C. Alternatively, said first maximum operating temperature may be 60° C. or higher, said second operating temperature may be less than about 50° C., and said third operating temperature may be greater than about 30° C.

In yet another aspect of Applicants' invention, said invention comprises the steps of monitoring an operating temperature of a drying apparatus during a drying cycle of said drying apparatus; and applying a fabric treatment composition to a fabric article after said drying apparatus has reached a first maximum operating temperature (e.g., as a control operating temperature) and then returned to a second operating temperature, but not before a third operating temperature is reached. In this operating scenario, the application of the fabric treatment composition could be allowed to commence as soon as the second operating temperature has been reached, however, the system controller can prevent that application until after the actual operating temperature has fallen below the third operating temperature, essentially as a maximum threshold temperature. In general, the actual temperature of the drying apparatus should be less than this third (threshold) operating temperature once the second operating temperature is reached, but that may not always be the case if the first and second operating temperatures work together as a differential temperature, without reference to a physical temperature in degrees C. or F. In other words, if the drying apparatus operates at temperatures somewhat greater than expected, then the second operating temperature may be reached, however, that second operating temperature may nevertheless be greater than desired with regard to dispensing or applying the fabric treatment composition. The above logic of preventing the application of the fabric treatment composition until the actual temperature has fallen below the third (threshold) operating temperature thus would achieve a desired result. In another aspect of Applicants' invention, said invention comprises the steps of monitoring an operating time of a drying apparatus during an operation cycle of said drying apparatus; and applying a fabric treatment composition to a fabric article during said operation cycle of said drying apparatus, said application occurring during a final portion of said operation cycle. Said final portion of said operation cycle may be 25%, 18%, 12% or 8% of an entire operation cycle. 25% of an entire operation cycle may be equal to or less than about 15 minutes, 18% of an entire operation cycle may be equal to or less than about 12 minutes, 12% of an entire operation cycle may be equal to or less than about 8 minutes, and 8% of an entire operation cycle may be equal to or less than about 6 minutes.

In another aspect of Applicants' invention, said invention comprises the steps of monitoring an operating time of a drying apparatus during an operation cycle of said drying apparatus; and applying a fabric treatment composition to a fabric article between about the last 18% of said operation cycle and about the last 0.75% of said operation cycle. Alternatively, said fabric treatment composition may be applied between about the last 12% of said operation cycle and about the last 1.7% of said operation cycle. Alternatively, said fabric treatment composition may be applied between about the last 8% of said operation cycle and about the last 2.5% of said operation cycle. 18% of an entire operation cycle may be equal to or less than about 12 minutes, 12% of an entire operation cycle may be equal to or less than about 8 minutes, and 8% of an entire operation cycle may be equal to or less than about 6 minutes.

In one aspect of Applicants' invention, the treatment composition is sprayed, in accordance with one of the aforementioned temperature or time profiles, on to said fabric article.

In one aspect of Applicants invention the treatment composition that is applied, in accordance with one of the aforementioned temperature or time profiles and by a processes including, but not limited to, spraying, to the fabric article comprises one or more perfume materials having a boiling point of less than or equal to 250° C. at 1 atmosphere. Suitable perfume materials and sources for obtaining such materials are described in the present specification under the heading "Fabric Treatment Composition".

In one aspect of Applicants' invention the treatment composition that is applied, in accordance with one of the aforementioned temperature or time profiles and by a processes including, but not limited to, spraying, to the fabric article comprises, a perfume that comprises at least about 30% by weight of a perfume material with a boiling point of less than or equal to 250° C. at 1 atmosphere.

In one aspect of Applicants' invention the treatment composition that is applied, in accordance with one of the aforementioned temperature or time profiles and by processes including, but not limited to, spraying, to the fabric article is a treatment composition that can comprise at least 0.005 wt. %, 0.005 wt. % to 10 wt. %, or 0.01 wt. % to 2 wt. %, 0.1 wt.% to 0.95 wt.%, of a material such as a perfume, said perfume comprising at least 30 wt. %, 30 wt. % to 90 wt. %, or 30 wt. % to 70 wt. %, or 30 wt. % to 50 wt. % of a perfume material having a boiling point of less than or equal to 250° C. at 1 atmosphere; optionally an additional fabric treatment material; an optional carrier, an optional moiety that is capable of acquiring an electric charge and optionally, capable of retaining an electric charge for a time period sufficient for the electrically charged liquid to contact a fabric article being treated, and the balance of one or more adjunct ingredients.

In one aspect of Applicants' invention the material that is applied, in accordance with one of the aforementioned temperature or time profiles and by processes including, but not limited to, spraying, to the article comprising a fabric, comprises a material that has a flash point, as measured according to American Society for Testing and Materials (ASTM) method D93-02a, of about 30° C. or higher, about 60° C. or higher, about 90° C. or higher, about 30° C. to about 400° C., about 60° C. to about 300° C., or about 90° C. to about 232° C.

Suitable delivery systems for delivering a fabric treatment composition in accordance with the above temperature profiles or time profiles include, but are not limited to, a fabric article treating system that sprays or otherwise releases a fabric treatment composition into a receiving volume, which could be the drum (or other chamber) of a clothes drying appliance, within which a fabric article is treated. The treating system would typically comprise: a housing or enclosure that contains a source of the fabric treatment composition, such as a reservoir or is in communication with an external source of the fabric treatment composition; an output device, such as a nozzle; a controller, such as an electronic control device with a processing circuit and input and output circuits; one or more sensors, such as a temperature sensor; one or more input devices, such as a start switch and/or a keypad; one or more indicating devices, such as color lights or LED's; and a charging system if the fabric treatment composition is to be electrostatically charged before (or while) being delivered.

Reference will now be made in detail to suitable embodiments of devices for delivering a fabric treatment composition in accordance with one of the aforementioned temperature or time profiles, an example of which is illustrated in the accompanying drawings, wherein like numerals indicate the same elements throughout the views.

Figure 3:
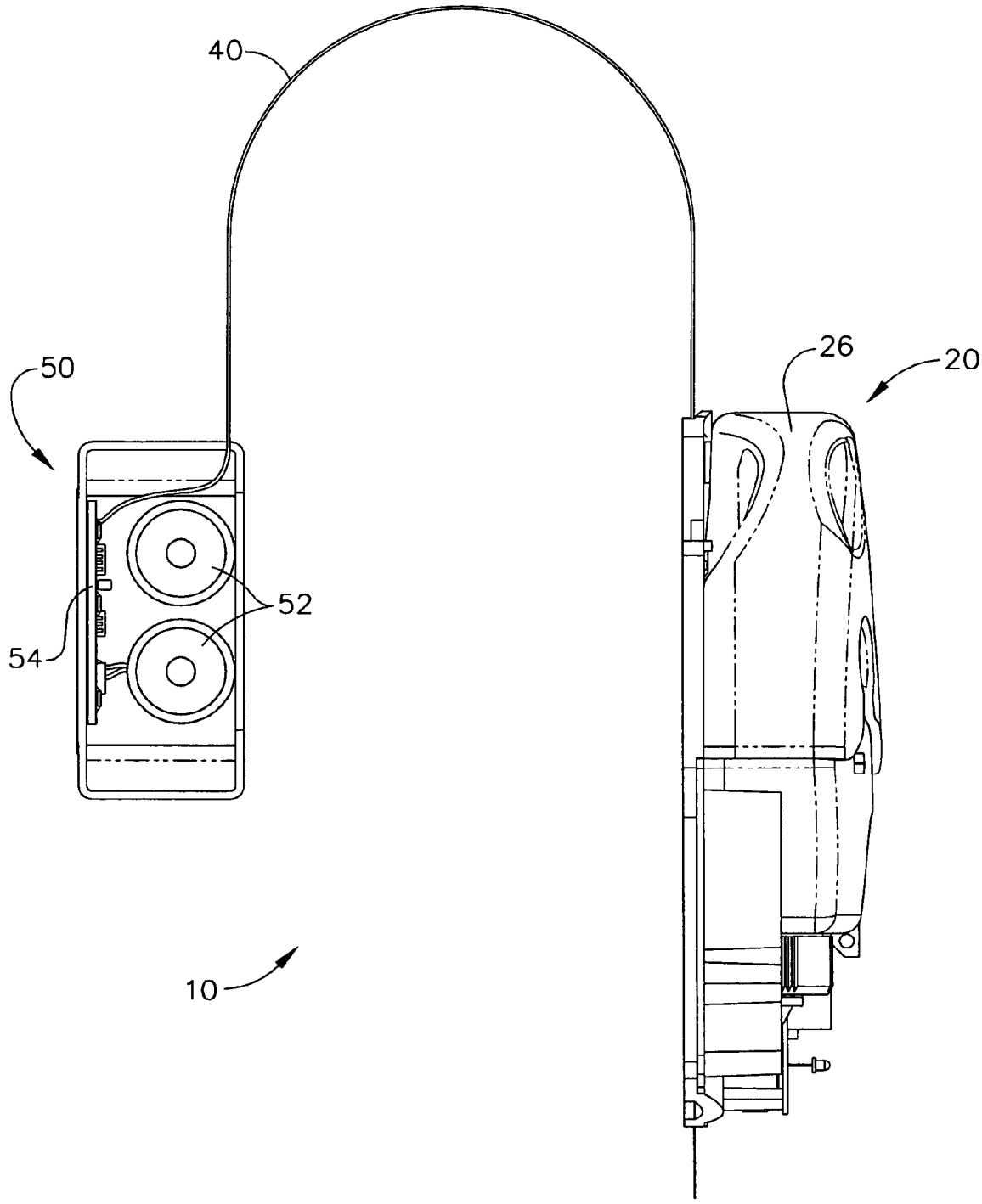
FIG. 3 is an elevational view from one end in partial cross-section of the fabric article treating apparatus of FIG. 1, illustrating the internal housing and external housing, as joined together by a flat cable.
Figure 4:
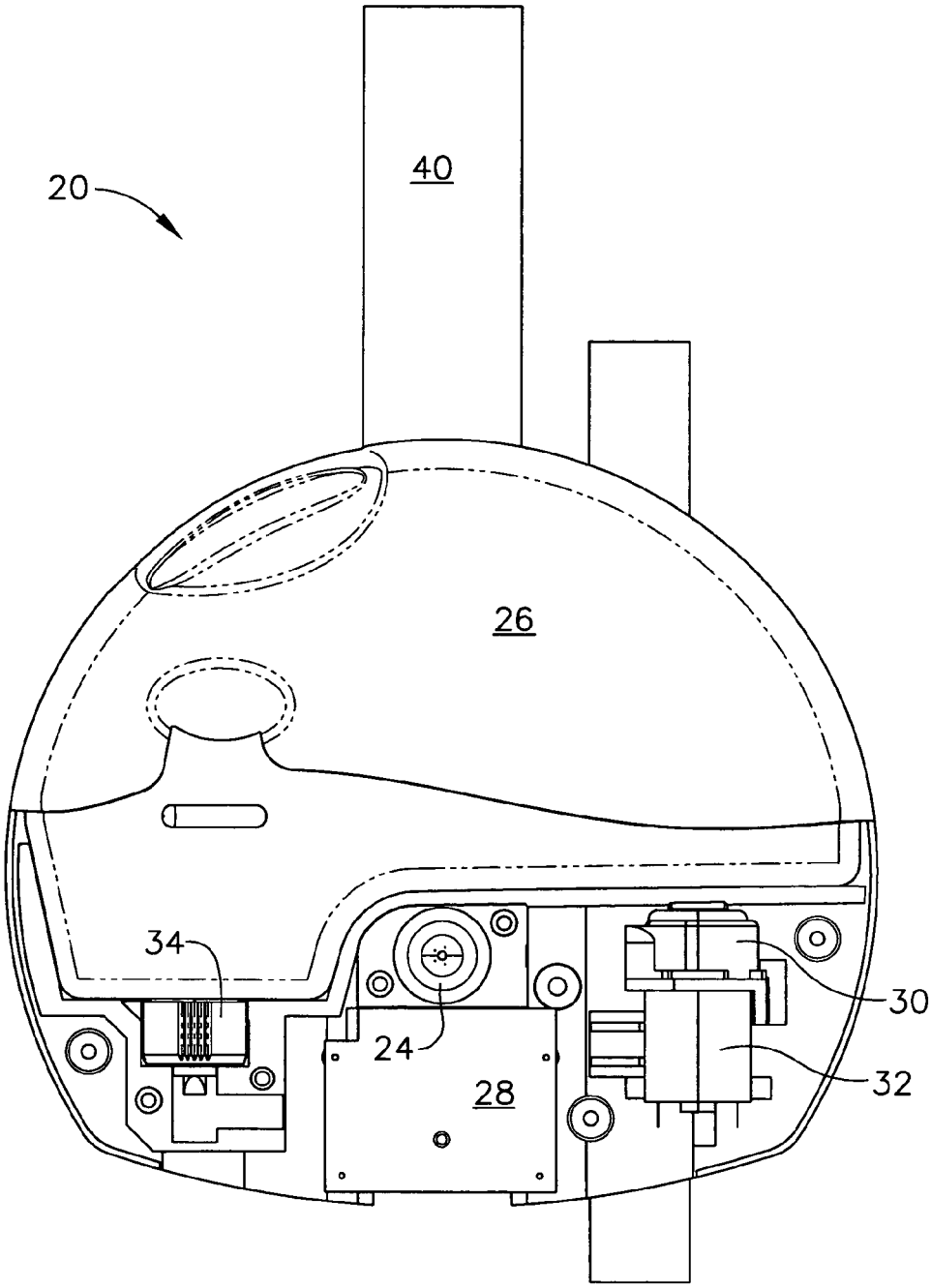
FIG. 4 is an elevational view from one side in partial cross-section of the internal housing portion of the fabric article treating apparatus of FIG. 1.
Figure 5:
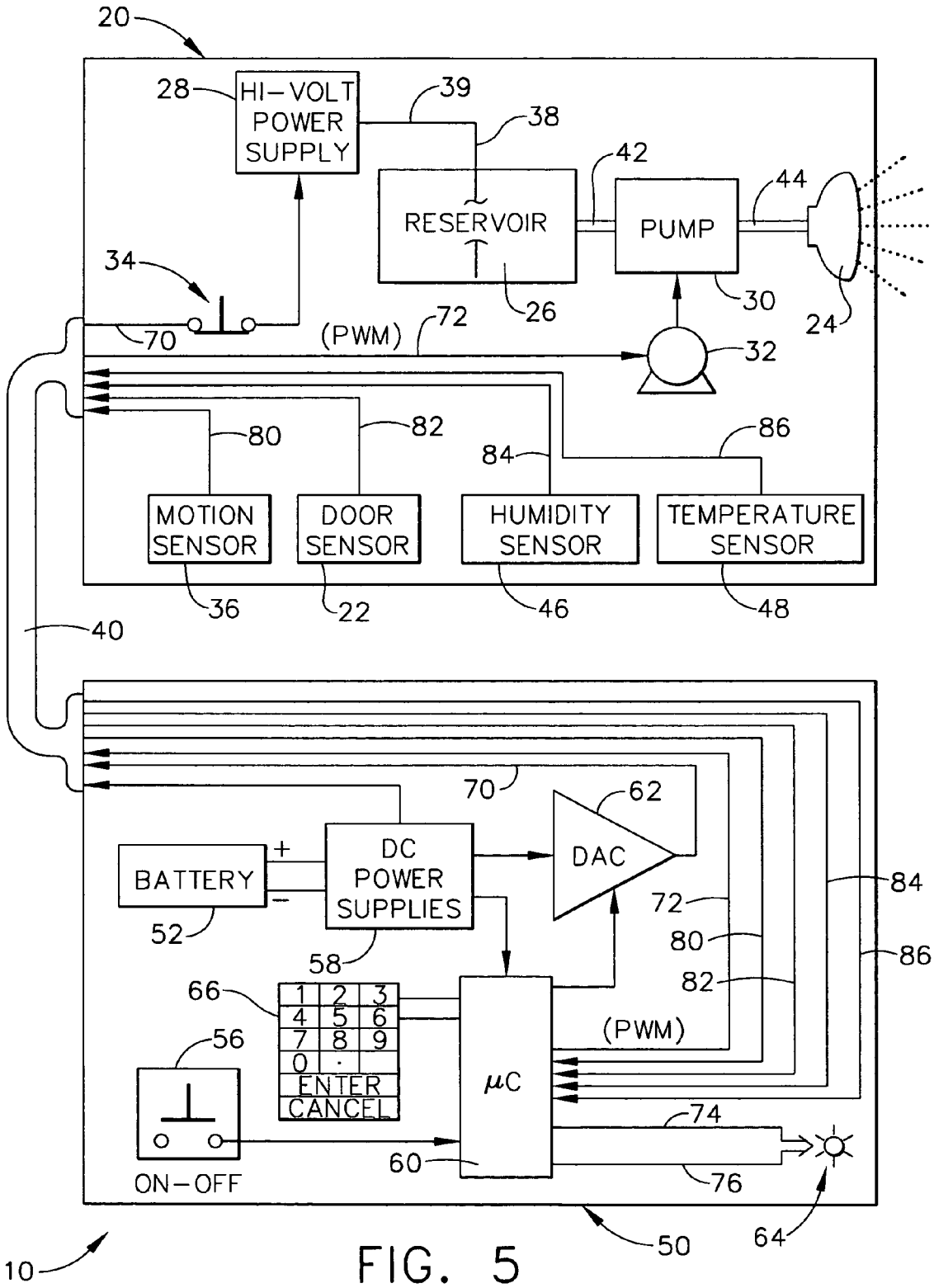
FIG. 5 is a block diagram of some of the electrical and mechanical components utilized in the fabric article treating apparatus of FIG. 1.
Figure 6A:
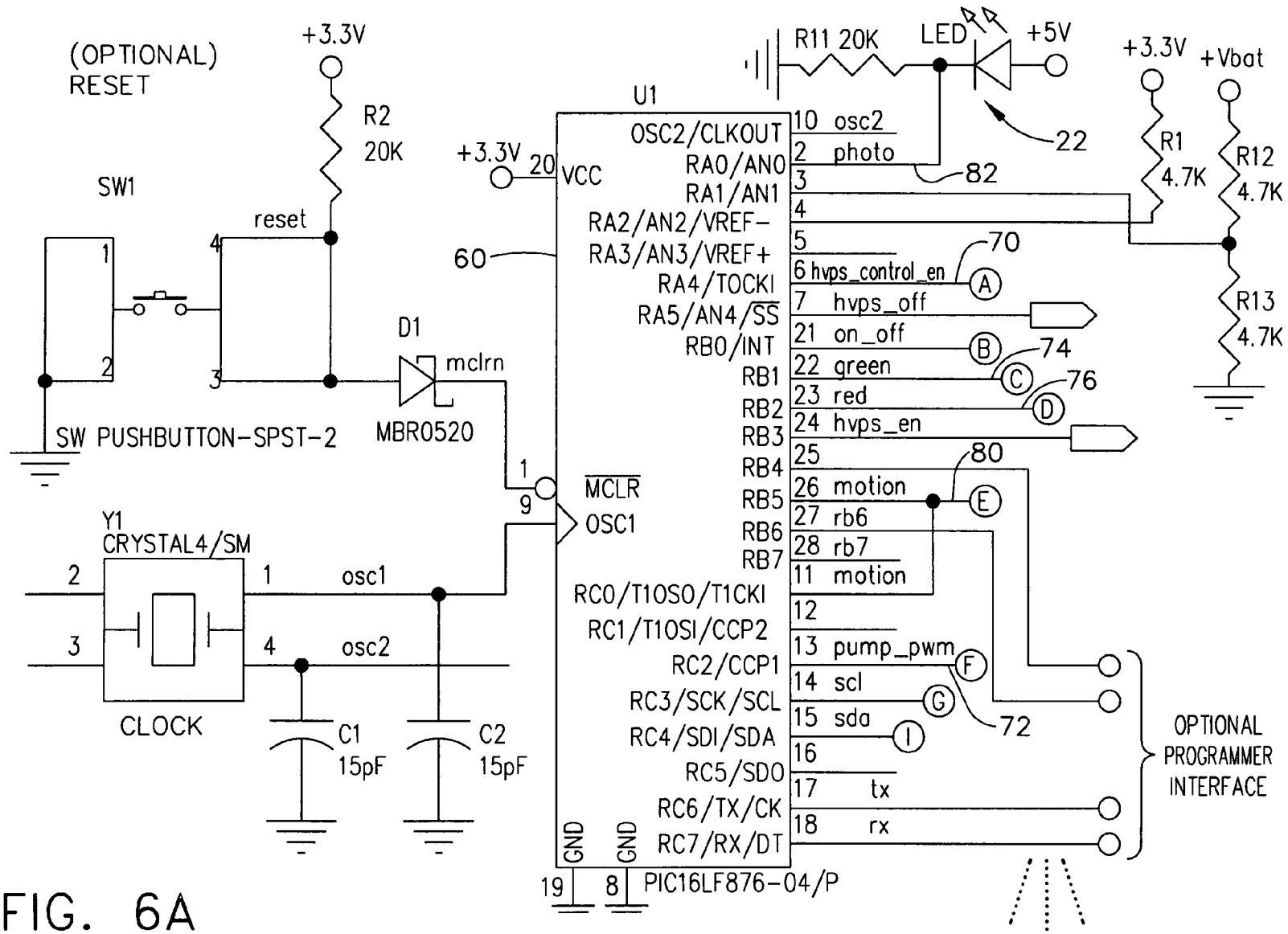
FIG. 6 (comprising FIGS. 6A, 6B, and 6C) is a schematic diagram of a first portion of the electronic controller utilized in the fabric article treating apparatus of FIG. 1.
Figure 6B:
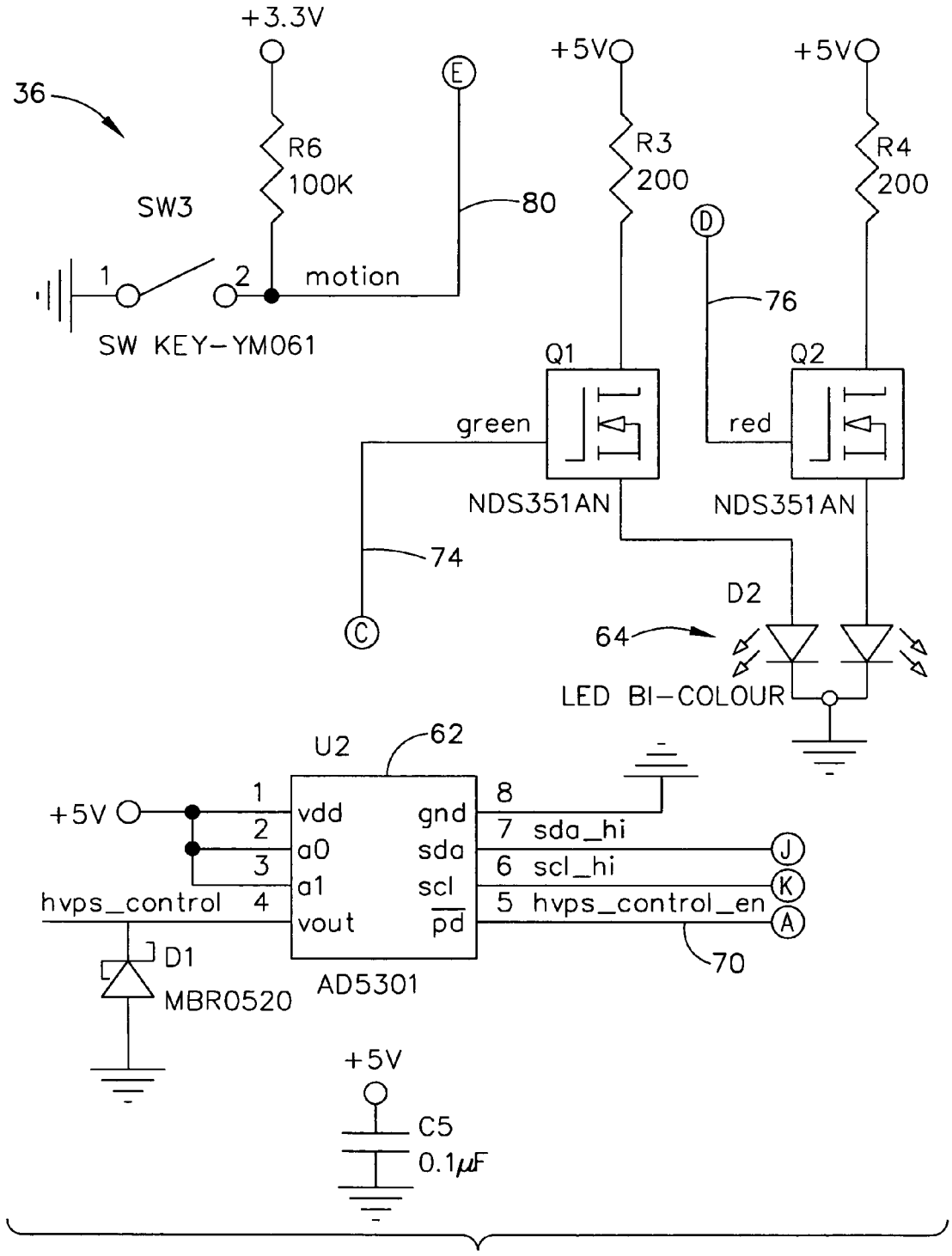
Figure 6C:
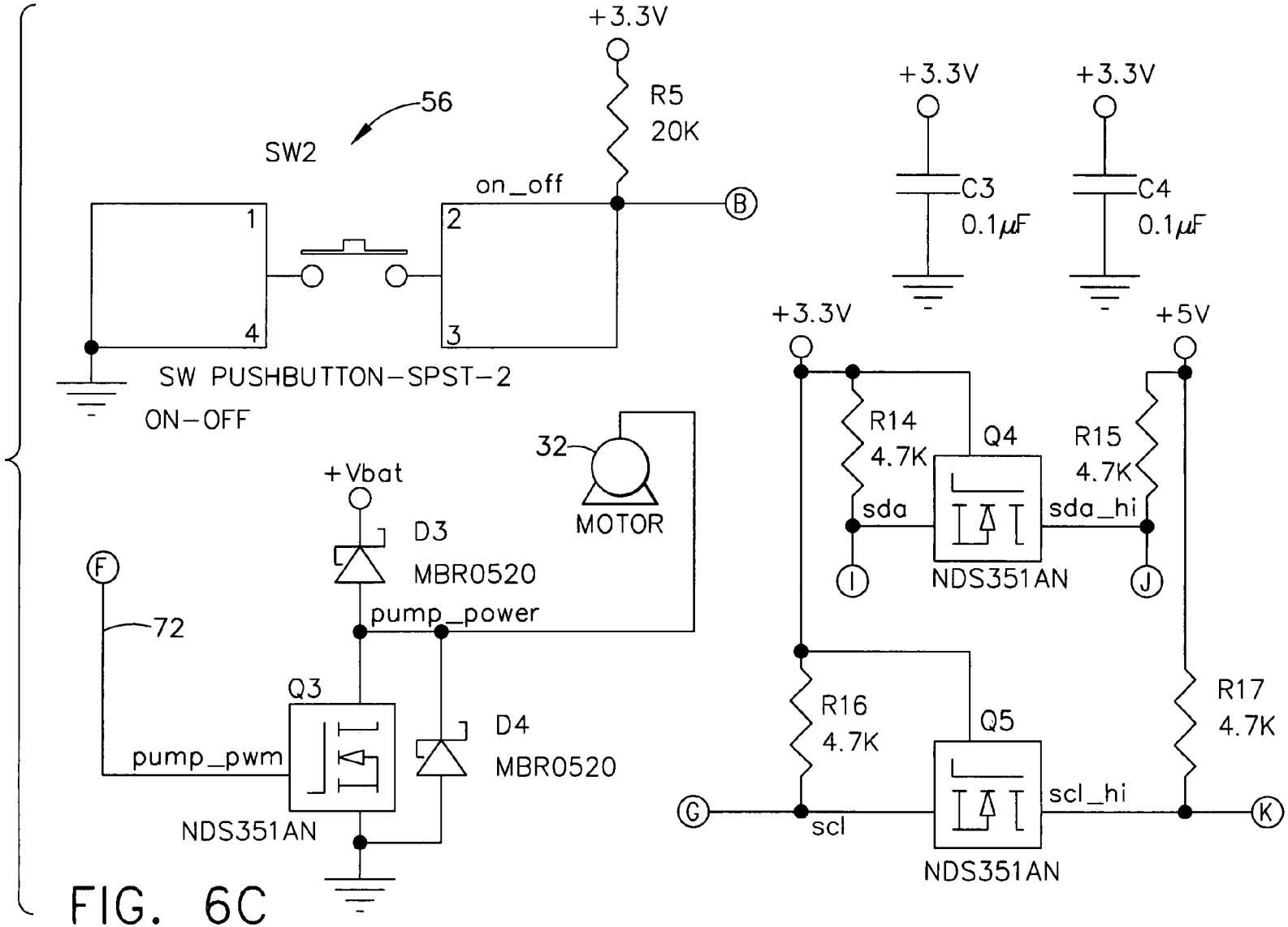
Figure 7:
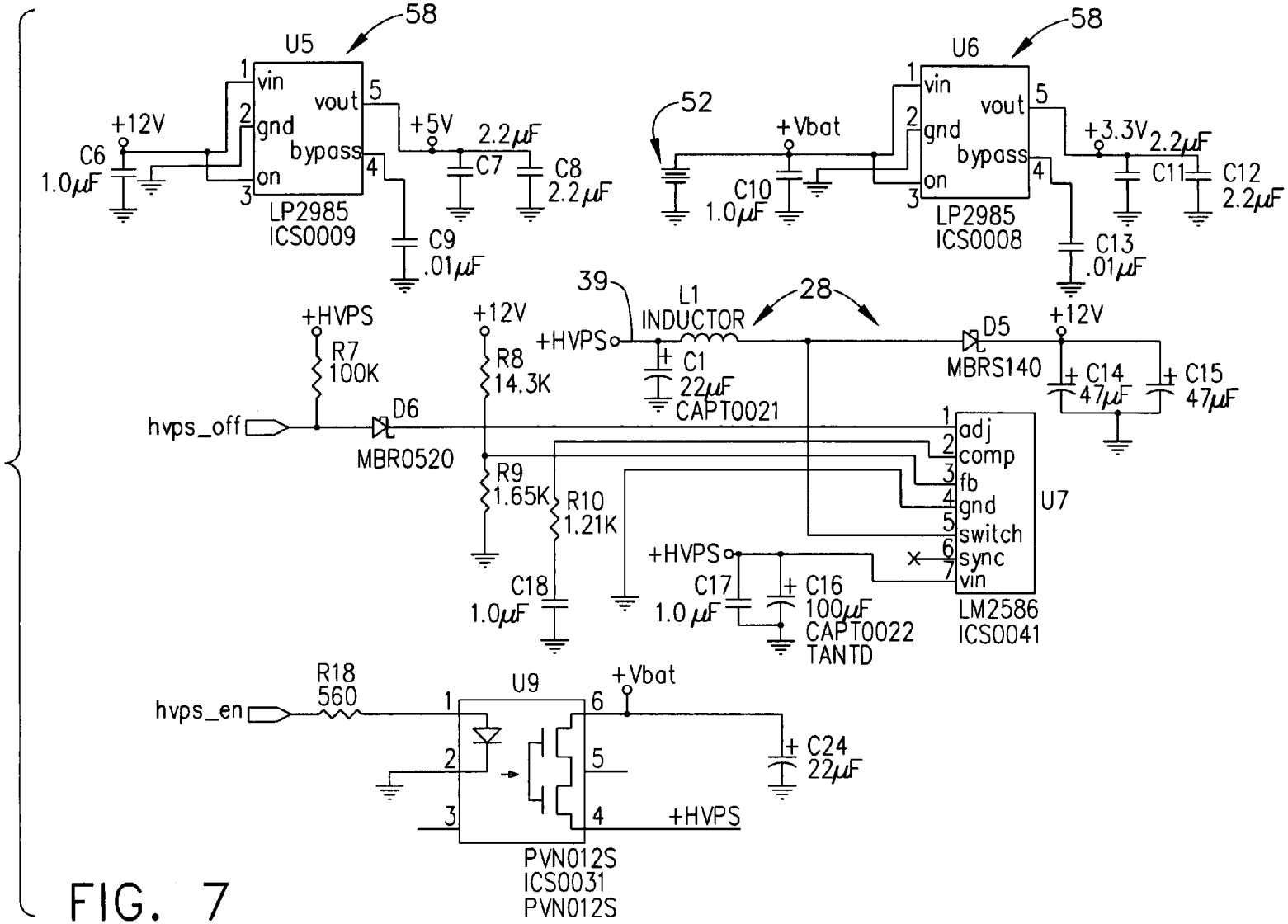
FIG. 7 is an electrical schematic diagram of other portions of the controller, including the power supply components, of the fabric article treating apparatus of FIG. 1.

FIGS. 1-4 illustrate one embodiment of an exemplary fabric article treating system for use in the present invention, while FIGS. 5-7 depict a suitable controller, and other electrical and electronic devices for use in the present invention. The methodologies for executing the above profiles are described in greater detail below, in the form of flow charts on FIGS. 11-12. Referring now to the embodiment of FIG. 1, a "stand-alone" controller and dispenser unit (i.e., as a self-contained device), generally designated by the reference numeral 10, is illustrated as having two major enclosures (or housings) 20 and 50. In this embodiment, the enclosure 20 acts as an "inner housing" which is located in the interior of a fabric article drying appliance (e.g., a clothes dryer), while the enclosure 50 acts as an "outer housing" that is located in the exterior of the fabric article drying appliance. The enclosure 50 may be mounted on the exterior surface of the fabric article drying appliance door, however, it may instead be mounted on any exterior surface, non-limiting examples of which include: the side walls, the top walls, the outer surface of a top-opening lid, and the like, including a wall or other household structure that is separate from the fabric article drying appliance. Furthermore, the enclosure 20 may be mounted on any interior surface of the fabric article drying appliance, examples of which include, but are not limited to: the interior surface of the door, the drum of the fabric article drying appliance, the back wall, the inner surface of a top-opening lid, and the like.

Figure 8:
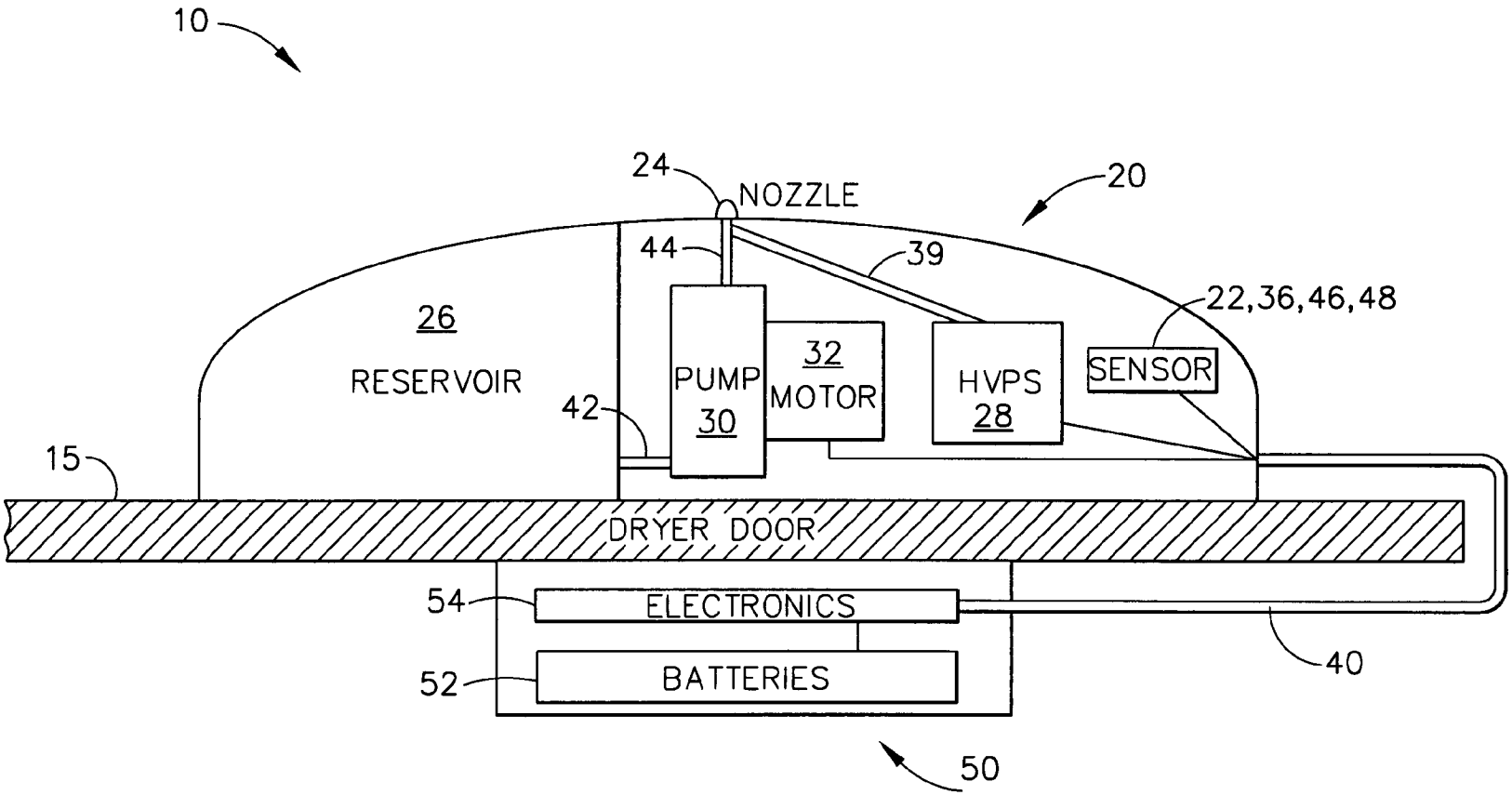
FIG. 8 is a diagrammatic view in partial cross-section of the fabric article treating apparatus of FIG. 1, as it is mounted to the door of a clothes dryer apparatus.

Enclosure 50 may be permanently mounted to the exterior surface, or preferably releasably attached to the exterior surface. Likewise, enclosure 20 may be permanently mounted to the interior surface, or releasably attached to the interior surface. One configuration for such an attachment is illustrated in FIG. 8, in which the door of the drying appliance is generally designated by the reference numeral 15.

When mounted on the interior surface of the door, for example, the enclosure 20 may be constructed so as to have the appearance of being "permanently" mounted, such that it seems to be "built into" the door of a dryer unit (or other type of fabric article drying appliance), without it actually being truly constructed as part of the fabric article drying appliance. On the other hand, enclosure 20 perhaps may be more loosely mounted near the door, or along side the interior surface of the door, much like one of the embodiments 10 as depicted in FIGS. 1-4 that "hangs" along a vertical door of the appliance. It will be understood that the term "door," as used herein, represents a movable closure structure that allows a person to access an interior volume of the dryer apparatus, and can be of virtually any physical form that will enable such access. The door "closure structure" could be a lid on the upper surface of the dryer apparatus, or a hatch of some sort, or the like.

It should be noted that the treating apparatus 10 may be grounded by way of being in contact with a grounded part of the fabric article drying appliance such as by a spring, patch, magnet, screw, or other attaching means, and/or by arc corona discharge, or by way of dissipating residual charge. One non-limiting way of dissipating the charge is by using an ionizing feature, for example a set of metallic wires extending away from the source. In many instances fabric article drying appliances such as clothes dryers have an enameled surface.

One method of grounding would be to ground to the enameled surface of the fabric article drying appliance by utilizing a pin that penetrates the non-conductive enamel paint for grounding thereto. Another method of grounding to the non-conductive surface of a fabric article drying appliance comprises the usage of a thin metal plate that is positioned between the fabric article drying appliance and the fabric article treating device which serves to provide a capacitive discharge. Typical thickness of such a plate is from about 5 microns to about 5000 microns.

In FIG. 1, a discharge nozzle 24 and a "door sensor" 22 are visible on the inner housing 20, which also includes a benefit composition-holding reservoir 26 within an interior volume of the inner housing 20. The reservoir 26 may be used to hold a benefit composition. The discharge nozzle 24 can act as a fluid atomizing nozzle, using either a pressurized spray or, along with an optional high voltage power supply (not shown in FIG. 1) it can act as an electrostatic nozzle. One suitable example of a fluid atomizing nozzle is a pressure swirl atomizing nozzle made by Seaquist Dispensing of Cary, Ill. under the Model No. of DU-3813. The benefit composition can comprise a fluidic substance, such as a liquid or a gaseous compound, or it can comprise a solid compound in the form of particles, such as a powder, or solid particles in solution with a liquid. Reservoir 26 can be of essentially any size and shape, and could take the form, for example, of a pouch or a cartridge; or perhaps the reservoir could merely be a household water line for situations in which the benefit composition comprises potable water.

The inner housing 20 and outer housing 50 are typically in electrical communication. In the embodiment of FIG. 1, a flat cable 40 (also sometimes referred to as a "ribbon cable") is run between the two housings 20 and 50, and travels along the inner surface of the fabric article drying appliance door 15 (see FIG. 8, for example), over the top of the door 15, and down the exterior surface of the door 15.

Figure 2:
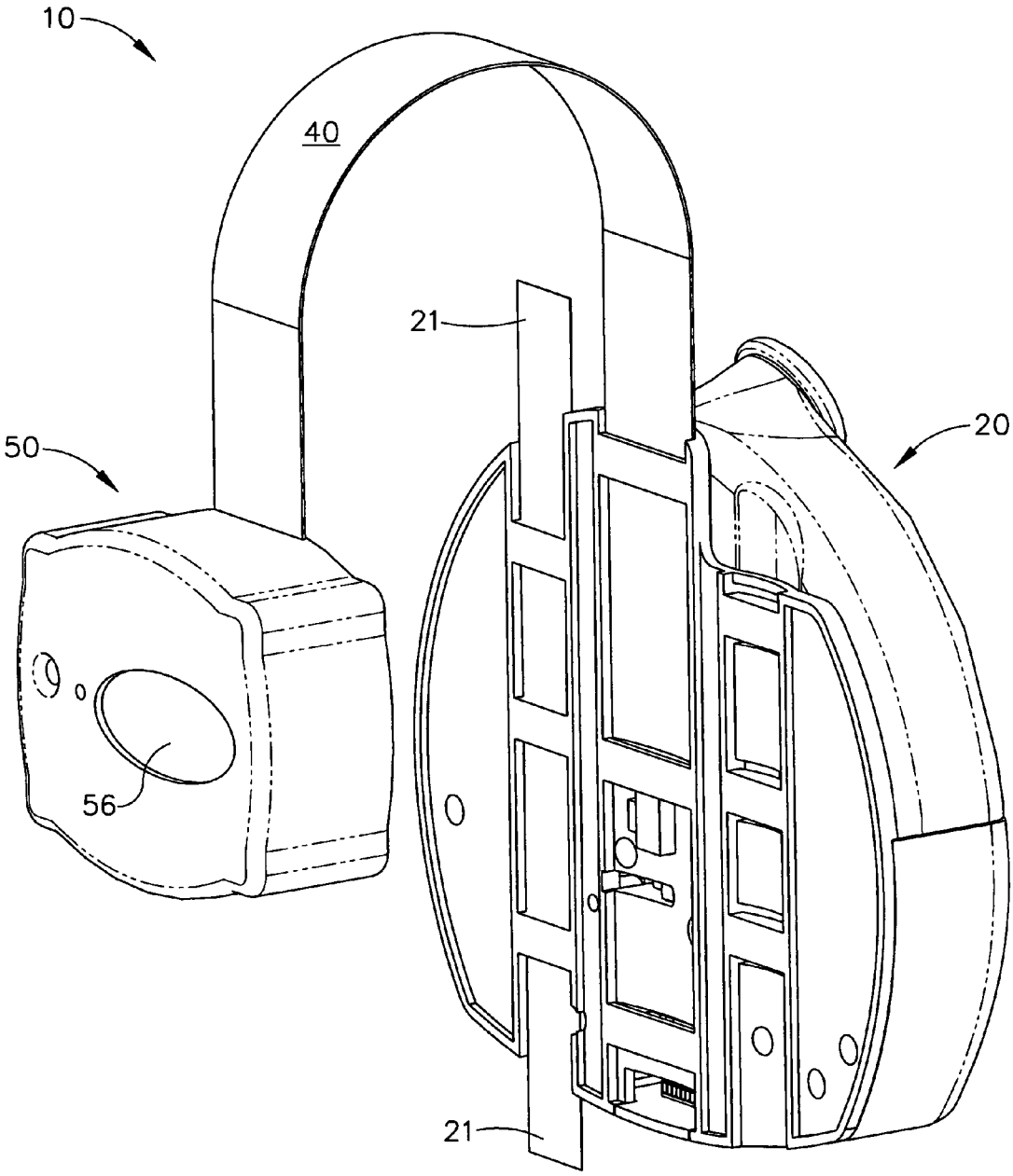
FIG. 2 is a perspective view from the opposite angle of the fabric article treating apparatus of FIG. 1.

FIG. 2 shows the same fabric article treating apparatus 10 from an opposite angle, in which the outer housing 50 is provided with an ON-OFF switch at 56. The flat cable 40 is again visible in FIG. 2, and along the surface of the inner housing 20 visible in FIG. 2, a door mounting strap 21 is visible. An end of the mounting strap is also visible in FIG. 1. Certainly other arrangements for attaching the inner housing 20 to a dryer door 15 (or other interior surface) are available without departing from the principles of the present invention.

Referring now to FIG. 3, the fabric article treating apparatus 10 is illustrated such that the reservoir 26 can be seen as an interior volume of the inner housing 20. In the outer housing 50, a set of batteries 52 can be seen, as well as a printed circuit board with electronic components at 54. The electronic components of one embodiment will be discussed below in greater detail. It will be understood that any type of electrical power source could be used in the present invention, including standard household line voltage, or even solar power. Batteries may be utilized if it is desired to make the apparatus 10 easily portable, however, any appropriate power adapter can be provided to convert an AC power source to the appropriate DC voltage(s) used in the electronic components on the PC board 54, or to convert a DC power source (including a battery or solar panel) to the appropriate DC voltage(s) used in the electronic components on the PC board 54.

Referring now to FIG. 4, some of the other hardware devices are illustrated with respect to the inner housing 20. In the embodiment of FIG. 4, the discharge nozzle 24 acts as an electrostatic nozzle, and thereby is coupled with a high voltage power supply 28, by use of an electrical conductor not shown in this view. A quick disconnect switch 34 is included for safety purposes, so that the high voltage power supply 28 can be quickly shut down if necessary. A pump 30 and a corresponding electric motor 32 are visible in FIG. 4. Some type of pumping apparatus is used regardless as to whether the discharge nozzle 24 is producing a pressurized spray only, or an electrostatic spray that utilizes a high voltage power supply 28.

FIG. 5 provides a block diagram of some of the electrical and mechanical components that are included in a fabric article treating apparatus 10, as constructed according to one embodiment of the present invention. In this example embodiment, the high voltage power supply 28 is provided in the inner housing 20, which will be used to electrically charge the fluid that will be dispensed through the discharge nozzle 24, thus making this an electrostatic nozzle system. The inner housing 20 utilizes a general body or enclosure to contain the devices needed within the drying appliance, and it will be understood that such components will generally be subjected to relatively high temperatures during the treatment cycle of the drying appliance. Consequently, the more sensitive electronic components will generally (but not always) be mounted in a different location, such as in the outer housing 50.

The flat cable 40 will bring certain command signals and electrical power into the inner housing 20, and will also receive electrical signals from sensors mounted in the inner housing 20 and communicate those sensor signals back to the outer housing 50. A power supply control signal follows a wire 70 through the quick disconnect switch 34 to the high voltage power supply 28. This signal can comprise a constant DC voltage, a constant AC voltage, a variable DC voltage, a variable AC voltage, or some type of pulse voltage, depending on the type of control methodology selected by the designer of the fabric article treating apparatus 10.

In one embodiment, the signal at 70 is a variable DC voltage, and as this voltage increases, the output of the high voltage power supply 28 will also increase in voltage magnitude, along a conductor 39 (e.g., a wire) that is attached to an electrode 38 that carries the high voltage to the nozzle 24, or into the reservoir 26. The voltage impressed onto the electrode 38 will then be transferred into the benefit composition. A constant output voltage DC high voltage power supply could optionally be used instead of the variable output voltage power supply 28 of the exemplary embodiment.

Once the benefit composition is charged within the reservoir 26 it will travel through a tube or channel 42 to the inlet of the pump 30, after which the composition will be pressurized and travel through the outlet of the pump along another tube (or channel) 44 to the discharge nozzle 24. For use in the present invention, the actual details of the type of tubing used, the type of pump 30, and the type of electric motor 32 that drives the pump, can be readily configured for almost any type of pressure and flow requirements. The electrical voltage and current requirements of the electric motor 32 to provide the desired pressure and flow on the outlet of the pump 30 can also be readily configured for use in the present invention. Virtually any type of pump and electric motor combination can be utilized in some form or another to create a useful device that falls within the teachings of the present invention, or a stand-alone pump can be used (i.e., without an associated electric motor), as discussed below.

It should be noted that some types of pumps do not require separate input and output lines or tubes to be connected thereto, such as peristaltic pumps, in which the pump acts upon a continuous tube that extends through an inlet opening and continues through a discharge opening of the pump. This arrangement is particularly beneficial for use with electrostatically charged fluids or particles that are being pumped toward the discharge nozzle 24, because the tubing can electrically insulate the pump from the charged benefit composition. It should also be noted that an alternative pumping device could be used, if desired, such as a spring-actuated pumping mechanism. A non-limiting example of a suitable peristaltic pump is the Model 10/30 peristaltic pump, which may be obtained from Thomas Industries of Louisville, Ky.

The types of control signals used to control the electric motor 32 can vary according to the design requirements of the apparatus 10, and such signals will travel along an electrical conductor 72 to control motor 32, via the flat cable 40. If the motor 32 is a DC variable-speed motor, then a variable "steady" DC voltage can be applied, in which the greater the voltage magnitude, the greater the rotational speed of the motor. In one embodiment, the electrical signal traveling along conductor 72 can be a pulse-width modulated (PWM) signal, that is controlled by a microprocessor or a microcontroller. Of course, such a pulse-width modulated signal can also be controlled by discrete logic, including analog electronic components.

The fabric article treating apparatus 10 can be enhanced by use of certain sensors, examples of which include but are not limited to a door (or lid) sensor 22, a motion sensor 36, a humidity sensor 46, and/or a temperature sensor 48. An analog output temperature sensor can be used to provide an analog signal along the electrical conductor 86 that leads back to the controller in the outer housing 50. (It should be noted that some temperature sensors have a serial bus to carry a digital output signal, rather than outputting an analog voltage.) The temperature sensor 48 may not be necessary for many of the control features of the treating apparatus 10, however, the interior temperature of the drying appliance could be used to determine the proper environmental conditions for certain spraying events to occur, particularly if a spraying event of the benefit composition in reservoir 26 is to take place during a "cool down" cycle of the drying appliance. This configuration will be discussed in greater detail below. In addition, the temperature sensor 48 can also be used as an indicator that the drying appliance is operating properly—if the drying appliance has not warmed up to a predetermined minimum temperature, then its heating element (or burner) may not be working correctly, and it may or may not be better if the benefit composition was not being sprayed in that circumstance.

The major components of the exterior housing 50 typically comprise the electronics 54 and the power source 52. For example, if power source 52 comprises four D-cell batteries connected in series, a +6 volt DC voltage will be provided to a set of DC power supplies generally designated by the reference numeral 58. The schematic drawings provided in FIGS. 6A-6C and 7 will show these power supplies 58 in greater detail, but for discussion purposes only, it will be presumed that more than one DC power supply voltage will be required by the control circuit in the outer housing 50. One of the DC power supply voltages provides energy for the high voltage power supply 28, via the electrical conductor 70 that runs through the flat cable 40. Another output voltage is provided to a microcontroller 60, which in the exemplary embodiment depicted in FIGS. 6A-6 C, requires a +3.3 volt DC power supply. In the exemplary embodiment of FIGS. 6A-6C, a digital-to-analog converter (DAC) 62 is used, and the device provided by Analog Devices of Norwood, Mass. (Part No. AD 5301), requires a +5 volt DC power supply. All of these power supplies are provided by the "set" of DC power supplies 58.

Part of the external housing 50 includes inputs to the microcontroller 60. One important element that could be used as a user interface to the microcontroller 60 would be a keypad 66, such as a set of bubble or membrane switches that have the numbers 0-9, as well as an "ENTER" key. Other keys could be included as part of keypad 66, including a "CANCEL" key, or perhaps a decimal point key.

Referring now to FIGS. 6A-6C, a component which can be used for controlling the treating apparatus is a microcontroller 60. A suitable microcontroller 60 is manufactured by Microchip of Chandler, Ariz., under the Part No. PIC16LF876-04/P, but of course, other microcontrollers made by different manufacturers could easily be used. Microcontroller 60 includes on-board Random Access Memory (RAM), on-board FLASH Memory, which comprises electrically programmable non-volatile memory elements, as well as on-board input and output lines for analog and digital signals. The microcontroller 60 may also be used with a crystal clock oscillator, although an RC circuit could instead be used as a clock circuit, if desired. The clock circuit provides the timing clock pulses necessary to operate the microcontroller 60, and these clock pulses may be divided down by logic components (or microprocessor registers, or software controlled memory) to provide a real time clock that is capable of counting time, for example, in seconds or tenths of seconds with reasonable accuracy. The PIC16LF876 microcontroller also has a serial port that can be interfaced to an optional programmer interface using an RS-232 communications link.

It will be understood that the microcontroller 60 could be virtually any type of microprocessor or microcontroller circuit commercially available, either with or without on-board RAM, ROM, or digital and analog I/O, without departing from the principles of the present invention. Moreover, a sequential processor is not necessarily required to control the treating apparatus 10, but instead a parallel processor architecture could be used, or perhaps a logic state machine architecture could be used. Furthermore, the microcontroller 60 could be integrated into an Application Specific Integrated Circuit (ASIC) that could contain many other logic elements that can be used for various functions, such functions being optional depending upon the model number of the treating apparatus 10 that will be sold to a consumer. To change model number features, the manufacturer need only program the ASIC (or the on-board ROM of a microcontroller) according to the special parameters of that particular model, while using the same hardware for each of the units.

It will also be understood that discrete digital logic could be used instead of any type of microprocessor or microcontroller unit, or even analog control circuitry could be used along with voltage comparators and analog timers, to control the timing events and to make decisions based on elapsed time, or based upon the input levels of the various sensors that are provided with the treating apparatus 10.

FIGS. 6A-6C also include an optional reset switch designated SW1. Such a reset switch may not be desired for a consumer apparatus. The ON-OFF switch 56 is interfaced to one of the I/O inputs to the microcontroller 60. A number of other inputs may be provided to the microcontroller, including output signals from door sensor 22, or motion sensor 36. Other inputs not depicted on FIGS. 6A-6C could include analog inputs for temperature and humidity sensors, as illustrated on FIG. 5.

Microcontroller 60 also controls certain outputs, including a pulse-width modulated (PWM) signal along conductor 72 that drives a transistor Q3, which converts the signal to a higher voltage and greater current that drives the motor 32.

Other digital outputs from the microcontroller 60 run through a voltage shifting circuit of transistors Q4 and Q5, which shifts the signals from 3.3 volt logic levels to +5 volt logic levels to control the DAC 62. Depending upon the states of these signals, the output of DAC 62 will be an analog voltage along the conductive pathway 70 that controls the high voltage DC power supply's output voltage magnitude, as discussed above. As also discussed above, this DAC 62 may not be required for full production units, particularly if it is determined that a constant DC output voltage is preferred as supplied by the high voltage DC power supply 28 (see FIG. 7). This can be determined by the system designer.

On FIGS. 6A-6C, the microcontroller 60 also outputs two control signals to a visual indicator with two LEDs of two different colors. In this example embodiment, the LEDs used are green and red. The output signal along a conductive pathway 74 drives a solid state transistor Q1, which will turn on a green LED, as desired. Another output signal along a conductive pathway 76 drives a solid state transistor Q2 that provides current to drive a red LED. Both the red and green LEDs are part of a single bi-color device, generally designated by the reference numeral 64. When desired, the green light will be displayed to the user, or the red light will be displayed. Also, both LEDs can be energized simultaneously, which will produce a yellow color discernible by a human user.

As a non-limiting example of how the bi-color LED 64 could be used, a steady green color could represent an "ON" signal for the fabric article treating apparatus 10. If the motion sensor 36 is discerning movement in the dryer that sets up a sufficient vibration to actuate the motion sensor 36 itself, then the green light could be flashing, for example. This could be a normal state for using the treating apparatus 10. During "spraying events" both the red and green LEDs could be energized, thereby showing a yellow color. This may inform the user that the spray droplets are actually being dispersed by the nozzle 24. If the door is opened, then the bi-color LED 64 could show a red color. If the battery voltage falls below a predetermined threshold, then the bi-color LED 64 could emit a flashing red light discernible by the user. These are just examples of possible indications for various operating modes. The colors of steady or flashing lights in various colors is completely up to the system designer and has much flexibility while falling within the teachings of the present invention. There are also many other methods of presenting operational information to the user, including an LCD display, or multiple individual lamps or LED's, and such alternative methodologies fall within the scope of the present invention.

Referring now to FIG. 7, the power supply circuits 58 are depicted in greater detail. The battery may be used to drive a voltage regulator U6, which outputs a +3.3 DC volt power supply rail. The regulator in this embodiment is an integrated circuit chip, Part No. LP2985 which may be obtained from National Semiconductor, of Santa Clara, Calif. Another voltage regulator chip U5 is used to provide a +5 volt rail from a +12 volt power supply voltage, which is another LP2985 regulator device (also available from National Semiconductor). FIG. 7 also depicts a boost switching regulator, which uses a +12 volt DC input power supply voltage and a switching regulator chip U7, which is an integrated circuit chip, Part No. LM2586 device, and also is available from National Semiconductor. Such voltage regulator chips are available from other semiconductor manufacturers as well. The boost regulator is generally designated by the reference numeral 28, which is referred to in the earlier figures as the high voltage power supply. The output voltage is located at the node indicated by the reference numeral 39, and this represents an electrical conductor that carries the high voltage to the electrode 38 that charges the benefit composition in the reservoir 26, or at the nozzle 24. FIG. 7 also shows a solid state relay U9 that directly provides current for the high voltage power supply rail (i.e., conductor 39 ) from the battery voltage.

FIG. 8 diagrammatically shows the general location of some of the components of one of the stand-alone embodiments of the fabric article treating apparatus 10 of the present invention. As discussed above, the electronics 54 and the batteries 52 are located within the outer housing 50, which is electrically connected to a flat cable 40 that carries power supply and input/output signals between the outer housing 50 and the inner housing 20.

Contained within the inner housing 20 are the reservoir 26, pump 30, electric motor 32, high voltage power supply 28, discharge nozzle 24, and various sensors that may or may not be included for a particular version of the treating apparatus 10. The electrical conductor 39 is depicted, which carries the high voltage to the nozzle 24, and this is one configuration that could be alternatively used instead of carrying the high voltage to the reservoir 26. The tubing 42 to the inlet of the pump is illustrated, as well as the tubing 44 from the outlet of the pump that provides the benefit composition to the nozzle 24. It should be noted that the high voltage power supply 28 is strictly optional within the teachings of the present invention; if spray droplets/particles emitted from the nozzle 24 are not to be electrostatically charged, then there is no need for a high voltage power supply within the inner housing 20.

Figure 9:
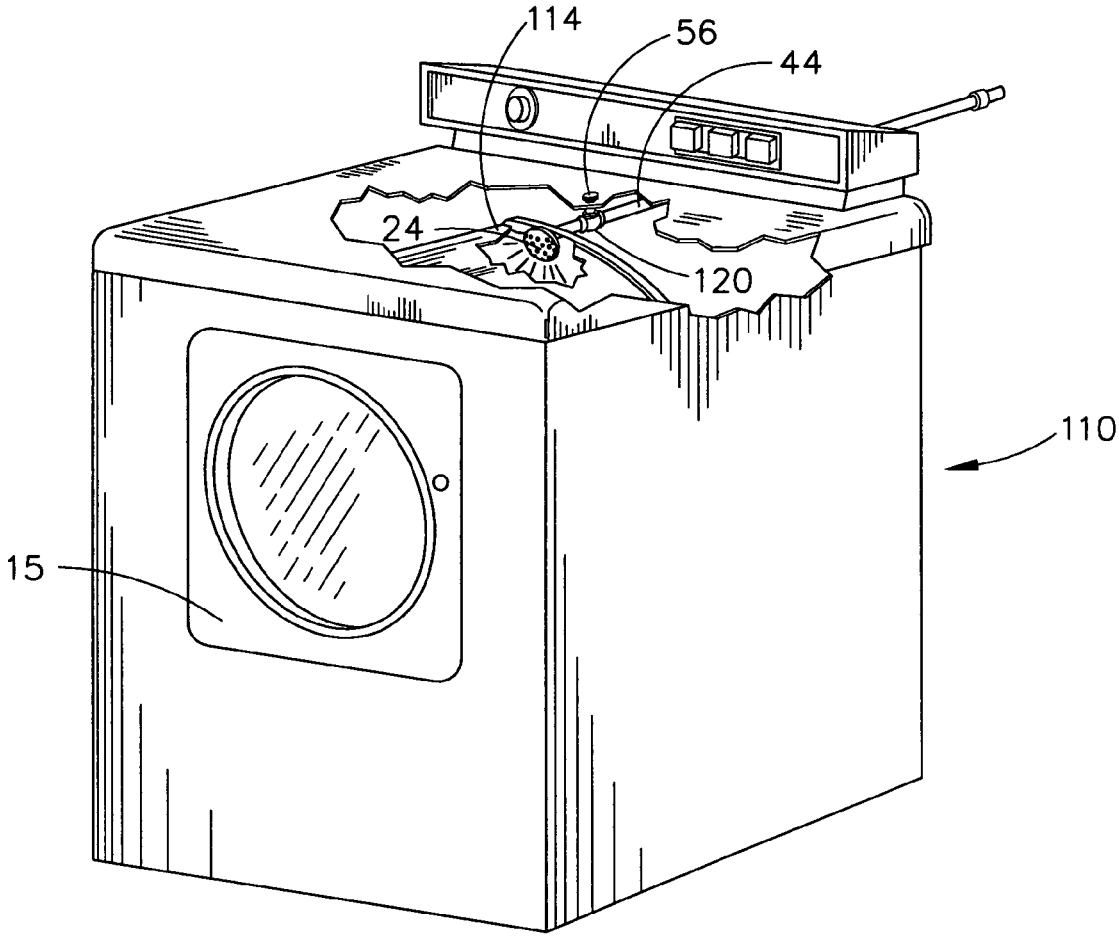
FIG. 9 is a perspective view of a fabric article drying appliance that has a nozzle which sprays a benefit composition into the drum portion of the dryer, as constructed according to the principles of the present invention.

FIG. 9 illustrates an alternative embodiment for use with the present invention, which depicts a fabric article drying appliance generally designated by the reference numeral 110. In this mode of the present invention, the controller depicted in the stand-alone embodiment of the earlier figures is now integrated into the electronic control system of the drying appliance 110. A door 15 is illustrated in FIG. 9, which is the normal point of access by a human user to the interior drum volume of the drying appliance 110. A nozzle 24 is used to direct a benefit composition into the drum area, in which the drum is generally designated by the reference numeral 114. A supply pipe 44 brings the benefit composition to the nozzle 24, through a control valve 120, that can have an ON/OFF push button 56, if desired.

Figure 10:
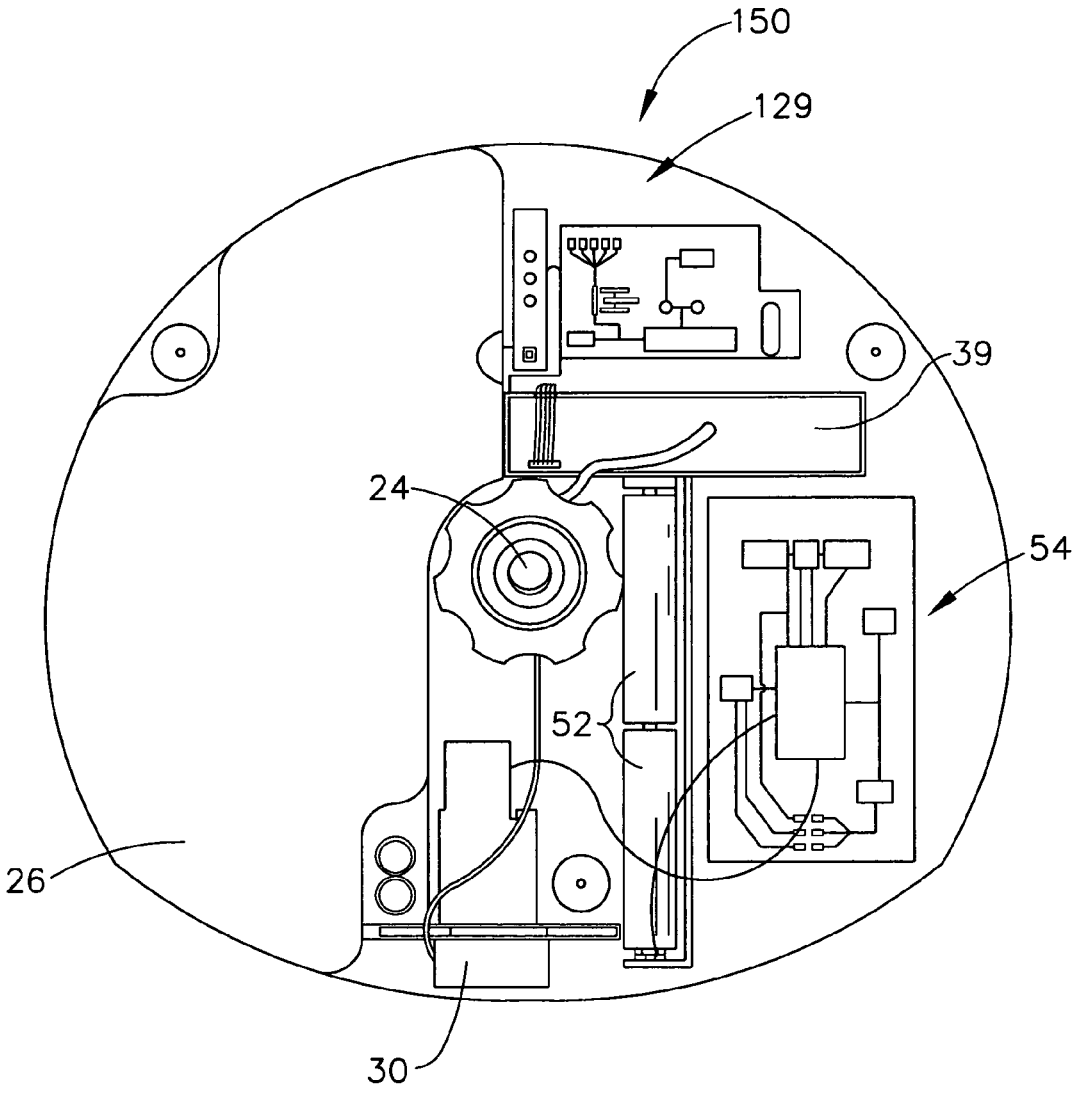
FIG. 10 is a diagrammatic view of some of the components utilized by an alternative embodiment stand-alone fabric article treating apparatus that is constructed according to the principles of the present invention, in which the entire treating apparatus is contained within a single housing or enclosure.

FIG. 10 illustrates an alternative stand-alone embodiment of the present invention, generally designated by the reference numeral 150. Components illustrated in FIG. 10 include a reservoir (or chamber) 26, an optional charging component 39 (such as an electrode or other type of electrical conductor that transports a high voltage to the reservoir or to the nozzle), a discharge nozzle 24, a pump unit 30, and a set of batteries 52. An electronic printed circuit board 54 is provided, which would typically include a microcontroller or other type of control circuit. One or more sensors are typically included in such a device, as depicted at the reference numeral 129, and could include a pressure sensor, a door sensor 22, motion sensor 36, humidity sensor 48, and/or a temperature sensor 48. In this embodiment 150, all of the components are enclosed in a single housing, and the entire unit is positioned within a fabric article drying appliance, such as a conventional clothes dryer found in a consumer's home.

It will be understood that the source of electrical energy used by the present invention may be provided in many different forms. For example, a battery (or set of batteries) can be used, such as the set of batteries 52, described above. However, standard line voltage could instead be used, such as 120 VAC, single phase power, at 60 Hz; or in Europe, the line voltage would likely be at 220 VAC at 50 Hz. For some installations, a more exotic source of electrical energy could be provided, such as a solar panel comprising photovoltaic cells or photoconductive cells.

The "single-housing" stand-alone unit 150 of FIG. 10 can incorporate all of the electrical and electronic components that are described herein with respect to FIGS. 5-7, including any optional features, such as the high voltage power supply and certain sensors used only in particular configurations of the present invention. Unless a different type of electrical power source is provided, there would be a need for a set of batteries 52, as illustrated in FIG. 10. There may be no need for an extended flat cable (such as flat cable 40 on FIG. 1) to carry electrical signals to and from the electronic controller on the printed circuit board 54, although some type of electrical conductors would be typically used for that purpose within the unitary device 150.

Figure 11:
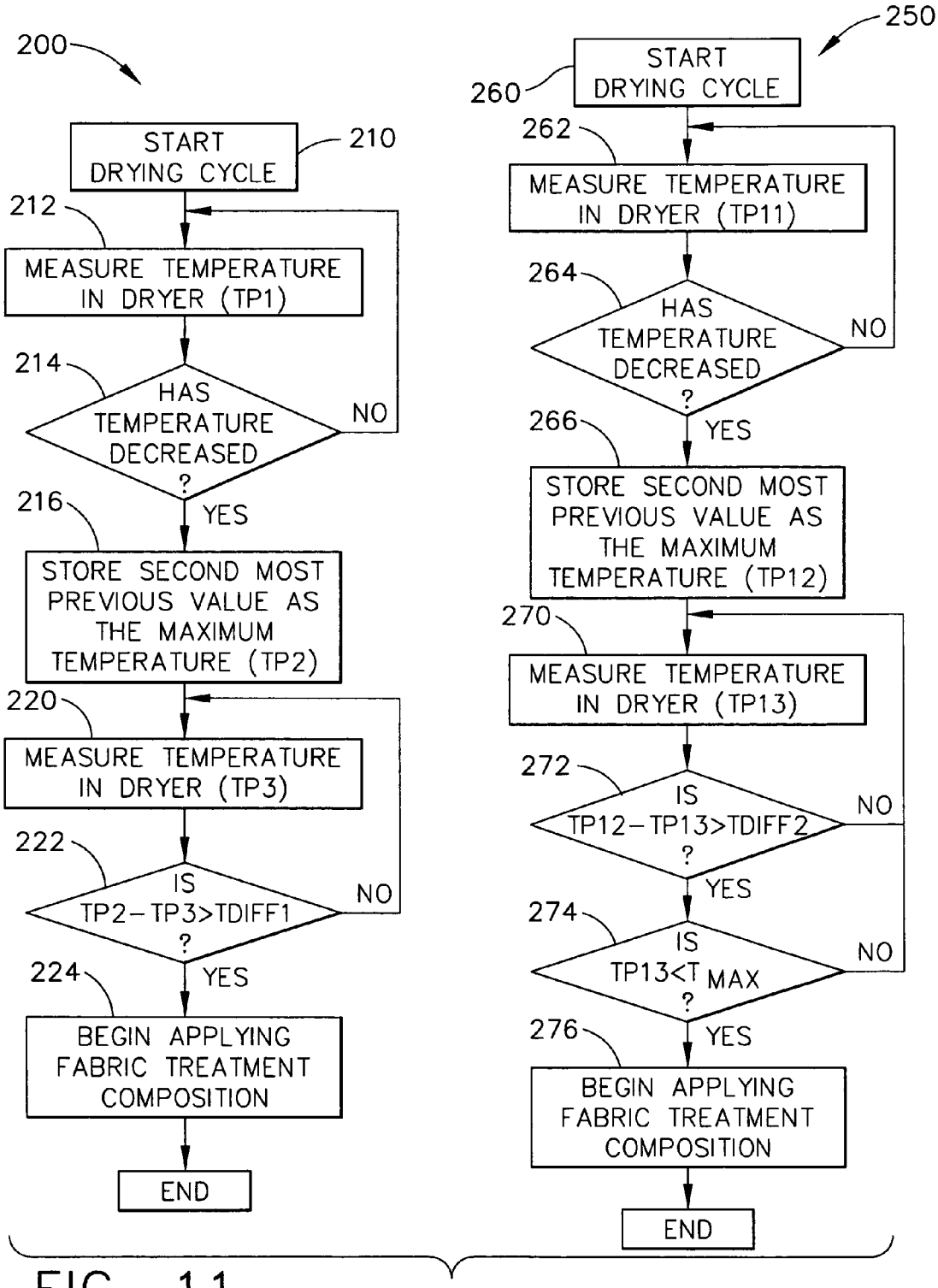
FIG. 11 is a series of flow charts that illustrate some of the logical steps used to control the fabric article treating apparatus of FIG. 1, using temperature inputs and setpoints as control variables.
Figure 12:
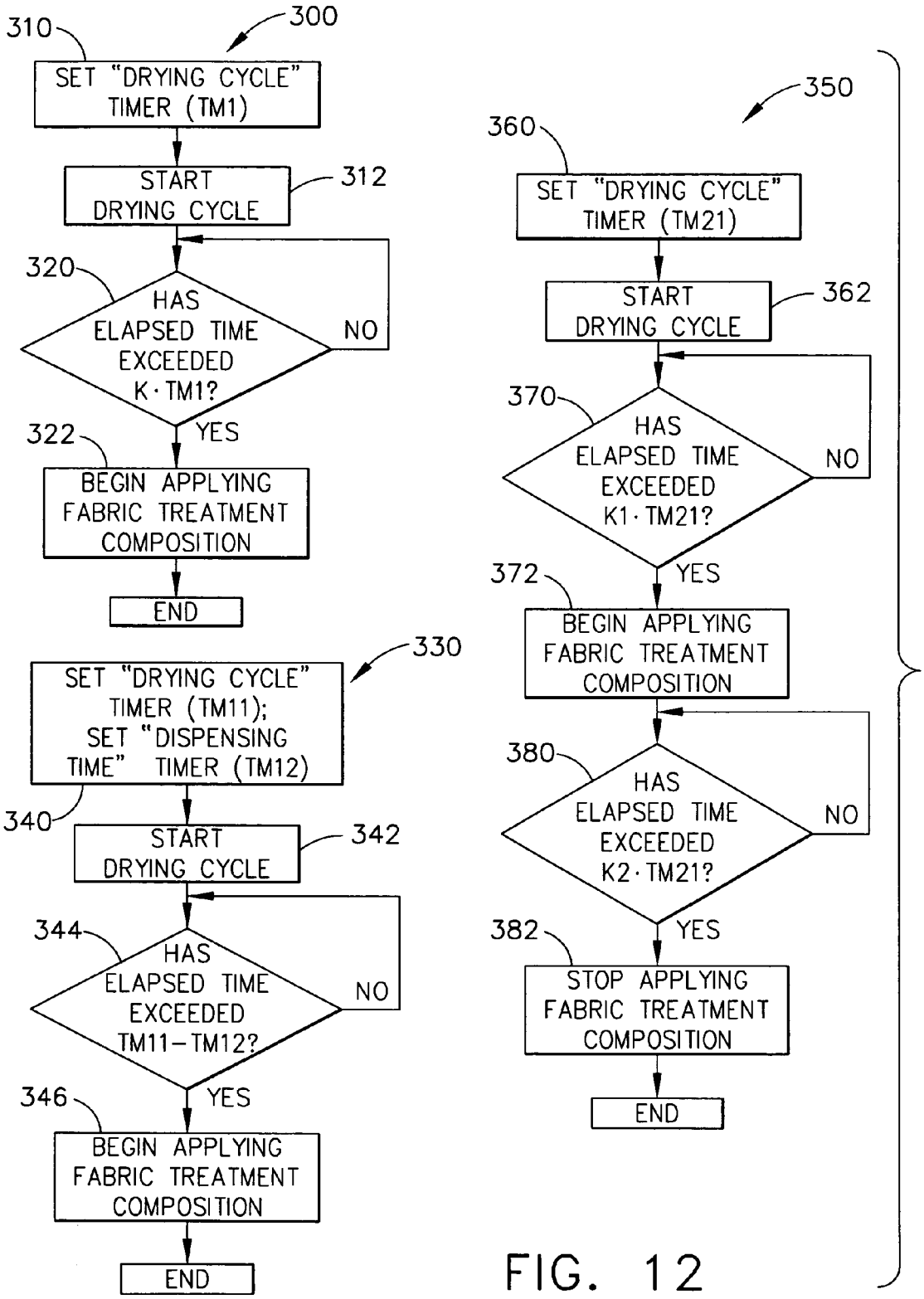
FIG. 12 is a series of flow charts that illustrate some of the logical steps used to control the fabric article treating apparatus of FIG. 1, using elapsed time and timing setpoints as control variables.

FIGS. 11 and 12 are flow charts illustrating some of the logical operations that are performed by a controller for use with the present invention when used in dispensing or applying a benefit composition. The term "benefit composition" will also be referred to herein as a "fabric treatment composition." In the flow charts of FIG. 11, the temperature within the chamber is used to determine when the fabric treatment composition should begin to be applied, whereas in FIG. 12, the elapsed time of the drying cycle is used to determine when the fabric treatment composition should start being applied.

Referring now to FIG. 11, a flow chart 200 begins at a step 210 that represents the start of a drying cycle of a drying apparatus, for example, a clothes dryer. The temperature inside the chamber of the dryer is repetitively measured at a step 212, and this would typically be accomplished by some type of logic processing device (such as a microcontroller or a microprocessor) that executes instructions and, in this circumstance, will sequentially execute steps that sample an input signal from a temperature sensor (e.g., sensor 48 on FIG. 5) and convert that signal to engineering units (in degrees F or degrees C), and after appropriate additional processing, will go back and sample that temperature once again (in a repetitive cycle). In the flow chart 200, this measured or sampled temperature of the dryer is referred to as "TP1 ".

The next step is a decision step 214 that determines whether or not the dryer's temperature has decreased since the previous reading at step 212. If the answer is NO, then the logic flow is directed back to step 212 where the dryer's temperature TP1 is again measured. During the beginning of a drying cycle in which a heating element (or burner) is actuated, it would be quite typical for the temperature to continually increase for a particular time period, and during that period, the logic flow will continually travel out the NO output back to the top of step 212. Only after the heating element has turned off would the temperature tend to begin decreasing for any significant amount. Once this occurs, the result from decision step 214 will eventually be YES, and the logic flow will be then directed to a step 216.

At step 216, the most previous sampled temperature value would not be the "maximum" value for this portion of the drying cycle. Instead, the second most previous sampled temperature value would be that "maximum" temperature value, and this value is referred to as "TP2". At step 216, the maximum temperature TP2 is stored in a memory element (or register) of the controller, or in a separate memory device. This could include the on-board memory of the microcontroller 60 (see FIG. 5). This maximum temperature TP2 is an example of the "first control operating temperature" that was discussed above.

The logic flow now travels to a step 220 where the dryer's temperature is again measured, and the measurement in this circumstance results in a variable named "TP3". TP3 is the same physical parameter as the dryer's temperature TP1, but the temperature is sampled and stored under this variable name TP3 only after the "maximum" temperature TP2 has been stored in step 216. (Note, this convention for naming the temperature variables is used merely for this description, and the actual software code may use the same variable name throughout the entire process.)

In most conventional dryers, whether for home use or commercial use, the heating element will be a binary device, such that it is always ON at full power or is completely OFF at zero power. A more expensive dryer apparatus could use a proportional controller to control an electrical heating element, for example, although the typical result of proportional control would nevertheless exhibit undershoots and overshoots about the setpoint temperature. The principles of the present invention could be used in such a proportional controller.

Assuming for this example that the heating element is a binary device, then while it is energized, the temperature will tend to continually increase within the drying chamber. Once the heating element is turned off, then the temperature will begin to decrease (although there could be some overshoot). During a single drying cycle, the heating element may be turned on and off several times, in which case a temperature versus time graph would have the appearance of a sawtooth waveform, in which an increasing slope (assuming temperature is the Y-axis and time is the X-axis) would occur when the heating element is turned on, and a decreasing slope when the heating element is turned off. During this sawtooth waveform interval, the overall temperature versus time chart will have the appearance of a plateau, in which the chart exhibits a relatively long increasing slope during the beginning of the drying cycle, then it reaches the plateau region (exhibiting the sawtooth waveform), and at the end of the drying cycle the slope will continually decrease on the "far" side of the plateau.

If the fabric treatment composition is a volatile material (such as certain perfumes), then it normally would be better to not release such volatile materials into the drying chamber until the temperature of that drying chamber is below a certain level, which might not occur until after the heating cycle has been completed. One way to detect this is to know when the heating element is actually energized or not, and an integral control device that is mated into the dryer's heating element controller would have knowledge of that status for the heating element, and thus could easily prevent any dispensing or application of the fabric treatment composition until after the heating element had been de-energized at the end of a heating cycle (as opposed to during the plateau region of the heating cycle, when the heating element could turn off, but also could later turn back on).

Assuming, however, that the heating element control status is not known to the fabric treatment composition dispensing controller, which would be the case if the dispensing apparatus was a self-contained unit that is not in communication with the dryer's controller, then another means of determining the end of the heating cycle would be required. One way of determining the end of a heating cycle (or "heating event") would be to determine the maximum and minimum temperatures that occur during the sawtooth waveform portion of the heating cycle, also referred to above as the "plateau region." If, for example, the internal temperature of the dryer's chamber will rise to a maximum temperature TP2, and then fall to a momentary "minimum" temperature that is about 10-15° C. lower than TP2, then the controller for the dispensing apparatus could determine when to begin applying the fabric treatment composition, which is after the dryer's internal temperature falls below maximum TP2 temperature, less the 10-15° C. "minimum" temperature. These sawtooth minimum and maximum temperature values can be considered a single differential temperature value, and that type of differential temperature will be referred to herein by a variable "TDIFF1". Some extra tolerance could be built in to the TDIFF1 value, so that, for example, if most home dryers rise and fall by approximately 15° C. during the plateau region of the drying cycle, then the value for TDIFF1 could be set to 20° C.

After a step 220 measures the dryer's actual temperature TP3, then a decision step 222 determines if the maximum temperature TP2 less the real time temperature TP3 is greater than the TDIFF1 value. If so, then the controller for the dispensing apparatus 10 can feel safe in coming to the conclusion that the heating cycle has ended. In this manner, the temperature sensor 48 could be used to determine when the fabric article drying appliance has entered into its cool-down cycle. In many circumstances, it is beneficial to wait until the dryer's cool-down cycle has commenced before beginning a spraying event. If the result in step 222 is NO, then the logic flow cycles back to measuring the actual dryer temperature at step 220. However, if the result is YES, then the logic flow is directed to a step 224, and the fabric treatment composition is now applied in the dryer's chamber. In flow chart 200, that is the end of this routine.

In general, the dryer's internal temperature will also be referred to as its "operating temperature" herein, which can be determined by a temperature sensor, such as the temperature sensor 48 on FIG. 5. The typical internal temperature of the dryer would physically be the air temperature within the drying chamber, and the placement of the temperature sensor (at the front wall, rear wall, top wall, or elsewhere) could affect the temperature setpoints selected when using the present invention. It also could be possible to monitor the temperature of the fabric articles themselves, and that physical parameter could be used as the "operating temperature," if desired.

The temperature sensor can be of any typical type, such as a thermistor, a thermocouple, or perhaps a platinum RTD. Moreover, the temperature sensor could also be more of an "on-off" device in some of the applications of the present invention. For example, a thermostat could be used to determine when a predetermined operating temperature has been achieved. In some applications of the present invention, the thermostat could be designed with a certain amount of hysteresis, so that it will change state (e.g., open) at a first temperature (e.g., at "TP2" on FIG. 11), then change state again (e.g., close) at a second temperature (e.g., at "TP3" on FIG. 11). Additional logic might be required when using an on-off, or digital, temperature sensing device.

It will be understood that the dryer's operating temperature is essentially being "continuously" monitored by the controller of the present invention, for example, the microcontroller 60 on FIG. 5. In most sequential processing devices, the software will execute instructions one at a time, and in the flow chart 200 the temperature TP1 is sampled at one executable instruction of the software, and then sampled again at a later time when the software "loops" back to that same (or a similar) executable instruction. This looping action often occurs so quickly that it appears to be virtually instantaneous, such that the controller seems to be continuously monitoring the temperature. However, it is not necessary to literally monitor the temperature (and other inputs) at each moment of time, because the controller operates much more quickly than any possible "quick" variations in the temperature, for example.

On the other hand, if the temperature sensor has a digital output (such as a thermostat with an electromechanical switching contact), then the effect of that type of sensor would literally be one of "continuously" monitoring the operating temperature of the dryer. (It would change state precisely when it determined that it should do so, and would not be "waiting" for a software instruction to first be executed.) Of course, the controller would not necessarily be continuously monitoring the digital input signal produced by the thermostat, since a sequential processing device would have many other tasks to perform. In essence, the controller typically would be sampling both digital and analog input data in some type of looping action, all under the control of the software instructions. However, if portions of the controller of the present invention are primarily made of discrete logic elements, using voltage comparators or parallel digital input gates (e.g., without a microprocessor), then the temperature in essence could be monitored in a continuous fashion, if desired.

As noted above, the controller of the present invention could be constructed as a sequential processing device, a parallel processing device, or perhaps as a logic state machine. If a sequential device is used (such as the microcontroller 60), it will be understood that its software instructions could be arranged in a manner so that it acts as a multi-tasking device. In that manner, it would be executing multiple routines virtually in real time by "jumping" from one routine to another in short time segments, even though perhaps none of those routines had been completed. An example of this would occur during the looping action around steps 212 and 214 of flow chart 200, while the system controller is "waiting" for the dryer's temperature to decrease. If the microcontroller 60 were performing only that task, then it would not be able to do anything else; that type of "real time programming" would not be efficient.

Referring again to FIG. 11, a flow chart 250 again starts with a drying cycle "Start" command at a step 260, and then measures the temperature in the dryer at a step 262. In flow chart 260, this real time temperature value is referred to as "TP11".

The logic flow now travels to a decision step 264 which determines if the temperature has decreased since a previous temperature sample, and if the answer is NO, the logic flow travels back to step 262 to once again sample the dryer's internal temperature TP11. However, if the temperature has decreased, the logic flow will travel out the YES output from step 264, and the second most previous value of the temperature TP11 will be stored at a step 266 as the "maximum temperature" TP12. So far in flow chart 250, these steps duplicate the logic of the flow chart 200.

A step 270 now measures the temperature in the dryer again, and this time it is stored as a variable TP13. A decision step 272 now determines if the difference between the maximum temperature TP12 and the current real time temperature TP13 is greater than the differential temperature TDIFF2, and if the answer is NO, the logic flow travels back to step 270 to take another temperature sample TP13. If the result is YES, then the logic flow travels to a new decision step 274.

At decision step 274, the current dryer temperature TP13 is compared to a threshold temperature, referred to herein as TMAX. In flow chart 250, TMAX represents the maximum actual dryer temperature that would be allowable before the fabric treatment composition should be dispensed. In the previous flow chart steps 260 through 272, all of the temperature readings TP11, TP12, and TP13 could be well above the maximum temperature TMAX. If that is the case, then the volatile material that is to be dispensed may not have the desired effect if it is applied onto the fabric immediately upon receiving the YES result at decision step 272. Instead, it would probably be better to wait until the temperature inside the dryer has cooled off some more, until it falls below the TMAX temperature threshold. Step 274 makes this determination, and if the result is NO, the logic flow travels back to measuring the temperature TP13 at step 270. However, if the result at step 274 is YES, then the logic flow travels to a step 276 and the fabric treatment composition is now applied to the dryer's chamber. This is the end of this routine.

A variation on the theme for flow chart 250 would be to allow the maximum temperature (TMAX) to be adjustable by a user, for example, using the keypad 66 (see FIG. 5). With a user entry being possible, the software that is executed by the controller of the device 10 would typically have a default value, so that the apparatus will automatically operate whether or not a user has entered any type of data. In that situation, a value for TMAX would already exist in the memory device for the controller (such as the microcontroller 60), and the numeric value for the maximum temperature, for example, could be as high as 70° C., or even perhaps as low as 25° C. The TMAX value would mainly depend upon the type of volatile material that is going to be dispensed by the fabric article treating system 10.

In another variation of the flow charts 200 and 250, the maximum temperature (TP2 or TP12) could itself have minimum or maximum values before being accepted as the "true" maximum temperature for a particular drying cycle. For example, if the fabric article treating system 10 is manufactured to work with a certain series of dryers that would typically heat their chambers to at least 80° C., and if the maximum temperature achieved during an operation is only about 50° C., then the controller may come to the conclusion that the dryer is not operating properly. In that circumstance, the controller could attempt to signal an error to the user by turning on an LED, for example. In addition, the controller can be programmed so as to prevent the fabric treatment composition from being applied at all in this circumstance (if that is the desired result). This type of decision can be left to the system designer, because it might also be desired to allow the fabric treatment composition to be dispensed, even though the fabric articles may not have been completely dried at the end of the drying cycle (since the "correct" maximum temperature was never achieved).

Referring now to FIG. 12, a flow chart 300 begins by setting the "drying cycle" timer at a step 310. The value for the drying cycle timer is stored in a variable called TM1 on this flow chart 300. The drying cycle timer would preferably be set to the same time interval as the controller for the drying apparatus itself. If the fabric article treating system has its controller integrally mated with the dryer's controller, then this drying cycle time could be immediately known to the controller (such as microcontroller 60) for the fabric article treating system 10. However, if the fabric article treating system 10 is a self-contained device that stands separate and is not in communication with the controller of the dryer itself, then a separate method must be used for entering the drying cycle timer value TM1. The keypad 66 on FIG. 5 would be a means for entering the drying cycle time, in which the user could manually key in the number of minutes for the drying cycle, for example. Again, the number of minutes entered on the keypad 66 would preferably match up to the number of minutes that the user would enter on the dryer's controller. An alternative timer entry device could instead be used, such as a dial device that has a rotating knob, for example.

Once the drying cycle timer value TM1 has been set, the drying cycle can start at a step 312. A decision step 320 now determines if the elapsed time for the drying cycle itself has exceeded a predetermined time interval. In step 320, the time threshold is referred to as K times TM1, in which the coefficient K represents a percentage of the entire drying cycle time TM1. In one mode of the invention, it is desirable to prevent the fabric treatment composition from being applied until the final 25% of the drying cycle time TM1. In that situation, the coefficient K would be set to 75%. This could be an internal default setting, or the system designer could also allow the user to set the coefficient K by use of the keypad 66 (although the next flow chart 330 may be somewhat more "user-friendly," since it allows the user to enter numbers in units of time, rather than as a percentage).

If the elapsed time has not exceeded K×TM1, then the logic flow travels back to the top of decision step 320 where it continues to take time samples until the elapsed time actually does exceed that value K×TM1. Once that occurs, then the logic flow travels out the YES result to a step 322. At that point, the fabric treatment composition begins being applied into the dryer's chamber, and this routine ends.

The logic of flow chart 300 could be used to either supplement or replace the logic discussed above in reference to FIG. 11. For example, if the dryer is going to be used in a "fluff" or a "refluff" mode, then the heating element of the dryer may not be energized at all. In that situation, one could not rely on any type of increasing or decreasing temperature readings, as they would have no value in determining exactly where the dryer's operating cycle currently stands. Instead, the elapsed time would be a much more valuable parameter for making determinations about when to apply the fabric treatment composition.

Furthermore, the drying cycle flow chart 300 could also supplement the flow chart 200 in situations where the dryer is supposed to increase its internal temperature, but for some reason became "short-cycled" such that its normal maximum temperature was never reached, or was used in a mode that did not energize the heating element to its normal extent (which might prevent the normal maximum temperature from being reached within a certain time limit). In that situation, the logic of flow chart 300 could be used to supplement the logic of flow chart 200, such that the elapsed time threshold K×TM1 would occur before the temperature specifications have been achieved for either decision step 222 or 274 on flow chart 200 or 250. In that situation, the fabric treatment composition could be applied according to the logic of decision step 320 on flow chart 300, regardless of the actual temperatures inside the dryer. If the maximum temperatures normally expected do not actually occur, then the actual temperature might be sufficiently low to allow the volatile material to be dispensed without being wasted in a "high temperature" chamber that otherwise might exist.

A flow chart 330 begins with a step 340 in which the drying cycle timer is set by the user, and is referred to as the variable TM11. In step 340, the user also sets a "dispensing time" timer, which is given the variable name TM12 on flow chart 300. The logic in this flow chart 330 allows the user to set an actual time in engineering units (e.g., minutes or seconds) that will determine the beginning of the application for the fabric treatment composition into the dryer's chamber. For example, if the drying cycle timer is set to sixty minutes (for TM11), and if the dispensing time timer is set to twenty minutes (for TM12), then the dryer will operate for forty minutes without any fabric treatment composition being applied, then with twenty minutes remaining in the drying cycle time, the composition will begin being applied.

The logic of flow chart 300 is as follows: at a step 342 the drying cycle starts. A decision step 344 now determines if the elapsed time has exceeded the difference between the times TM11 and TM12. If the answer is NO, the logic flow travels back to the beginning of step 344, which keeps "looping" until a sufficient elapsed time occurs so that the result finally becomes YES.

The logic flow now travels to a step 346 that begins applying the fabric treatment composition into the dryer's chamber, and that is the end of this routine. The logic of flow chart 330 could be determined by the system designer to be either user-enterable (via keypad 66, for example), or the dispensing timer value for variable TM12 could have a default value that will always be used in certain applications. For example, it may be desirable to always allow the fabric treatment composition to be dispensed for at least eight minutes at the end of a drying cycle, regardless of the total drying cycle time TM1. In that situation, then the dispensing time timer value TM12 could be set to eight minutes as a default value, and the system designer could make the software that executes on the microcontroller 60 such that this default value will always be observed regardless of other modes of operation. This will not necessarily be desirable for all applications of the fabric article treating system 10, but it at least is an option.

In general, the elapsed time during a drying cycle will also be referred to as the dryer's "operating time" herein, and can be determined by a virtually any type of time-keeping device. If a digital processing device is used (such as microcontroller 60 on FIG. 5), then a high-frequency clock typically will be included in the circuit design to cause the processing device to execute software instructions for each of the "clock cycles." The system clock's cycling rate can be readily divided down (by digital dividers) to a lower frequency to create "real time" intervals, such as one second or one-tenth second time periods (as noted above), and the dryer's operating time can be based upon such real time intervals. On the other hand, a separate clocking device could be provided, if desired, such as a digital counter that receives clock pulses from a separate pulse generator.

It will be understood that the dryer's operating time is essentially being "continuously" monitored by the controller of the present invention (for example, the microcontroller 60 on FIG. 5). In most sequential processing devices, the software will execute instructions one at a time, and in the flow chart 300 the elapsed time could be sampled at one executable instruction of the software (e.g., at step 320), and then sampled again at a later time when the software "loops" back to that same (or a similar) executable instruction. This looping action often occurs so quickly that it appears to be virtually instantaneous, such that the controller seems to be continuously monitoring the time, when in reality the elapsed time is being "sampled" according to the rate at which the looping action occurs.

However, if knowledge of the passing time to make device-operating decisions is considered critical, then the software could be written, for example, to generate a non-maskable interrupt upon the occurrence of each incremental increase in the real time clock (at each new clock pulse, or at each counter-clock change of state, for example), and the timing routines could be executed as part of the interrupt routine. Of course, if portions of the controller of the present invention are made of discrete logic elements, perhaps using pulse generators with digital counters and digital comparators (e.g., without a microprocessor), then the time in essence could be monitored in a continuous fashion, if desired.

Another example of using elapsed time is illustrated in a flow chart 350, in which the first step at 360 is to set the drying cycle timer, which has a value loaded into a variable TM21 in flow chart 350. The next step 362 starts the drying cycle.

A decision step 370 now determines if the elapsed time has exceeded a preset value as a time threshold that is related to the total drying cycle time TM21. This preset time uses a coefficient, much like the logic in step 320 of flow chart 300. In this flow chart 350, the coefficient is referred to as "K1", and the time threshold is referred to as K1 times TM21. K1 would normally be set as a percentage, and it is used for the final amount of the drying cycle. For example, if K1 is set to 75%, then the fabric treatment composition would be dispensed or applied during the final 25% of the drying cycle time interval TM21.

If the elapsed time has not exceeded this threshold K1×TM21, then the logic flow is directed back to the top of this decision step 370, where it continues to "loop" until a sufficient elapsed time has occurred to finally achieve the YES result. The logic flow now travels to a step 372 that begins applying the fabric treatment composition to the dryer's chamber.

The logic flow now travels to a decision step 380 that determines if the elapsed time has exceeded a different time threshold, referred to on flow chart 350 as the coefficient K2 times the drying cycle time TM21. This coefficient K2 would be a smaller number than the coefficient K1. If the result is NO, then the logic flow travels back to the top of decision step 380 where the logic continues to "loop" until a sufficient elapsed time occurs so that the YES result is finally achieved. Once that occurs, a step 382 stops the application of the fabric treatment composition into the dryer's chamber, which is the end of this routine.

Flow chart 350 thereby allows a user (or the system designer) to set both start and stop points during the drying cycle, and moreover, these starting and stopping coefficients can be pre-loaded into the software as default values. For example, if K1 equals 25% and K2 equals 0.75%, then the fabric treatment composition will start being applied at a point 75% into the elapsed time of the drying cycle, and the fabric treatment composition will stop being applied at an elapsed time of 99.25% of the entire drying cycle time TM21. This allows the fabric material inside the drying chamber to have a final tactile quality of being "dry" as opposed to feeling somewhat damp or wet. In other words, if the fabric treatment composition is dispensed completely to the end of the drying cycle, and if the user immediately opens the dryer door and grasps the fabric articles, there may be a somewhat wet or damp tactile quality to these articles. The logic of flow chart 350 would likely prevent that type of result. It may be desirable to limit the value of K2 so that it can never be set all the way to 100%.

It should be obvious that the logic of flow chart 350 could be combined with any of the previous flow chart examples on FIGS. 11 and 12, including the temperature-based logic of FIG. 11. As discussed above, the flow charts 200 and 250 only begin the application of the fabric treatment composition, and do not address exactly when the fabric treatment composition should be terminated. The flow chart 350 can be used for just that purpose in combination with the temperature-based logic of flow charts 200 or 250.

It will be understood that the logical operations of the flow charts of FIGS. 11 and 12 can be combined in various other ways than discussed above, while still falling within the principles of the present invention.

One optional aspect of the present invention is to provide the fabric treatment composition at two different time intervals during the drying cycle. For example, the fabric treatment composition could be applied fairly early during the drying cycle as a fabric softener; then at a later time (e.g., during the "cool-down" phase) the fabric treatment composition could be applied as a perfume, or perhaps to provide some other type of beneficial property or result. Such a dispensing program can be referred to as a "split cycle" of applying (e.g., spraying) the fabric treatment composition, since there typically may be a time interval during which no dispensing at all occurs during the drying cycle, after the first portion of spraying/dispensing has terminated.

The principles of the present invention nevertheless apply to a split cycle of dispensing, in which the volatile characteristics of the fabric treatment composition are best utilized near the "end" of the entire drying cycle of the drying apparatus. If that is a desired result, then the logical operations described in the flow charts of FIGS. 11 and 12 provide an exemplary set of processing steps that may be used to implement such dispensing or applying of the fabric treatment composition to the fabric articles.

It should be noted that there may be circumstances in which there would be no elapsed time interval between the two "split" dispensing cycles. This could occur, for example, if a very short drying cycle time has been selected by the user of the drying apparatus, or if a very small load of fabric articles has been placed into the drying chamber of the drying apparatus. In one of those circumstances, it may be possible for the first spraying event and the second spraying event to overlap, such that there would be no "true" split interval spraying procedure, because the first spraying event would not have terminated before it became time to begin the second spraying event. Thus there might not be an elapsed time interval during which no spraying at all would be occurring. However, with regard to the processing logic which determines "when" to apply the fabric treatment composition near the "end" of the drying cycle (such as the logic of the flow charts on FIGS. 11 and 12), the same decisions would still be made based upon the proper time and/or temperature input information. In other words, the controller's decision to "start" the "second spraying event" would have to be taken, otherwise the fabric treatment composition would stop being applied at the end of the "first spraying event" of this example, and the second spraying event might not begin at all.

Fabric Treatment Composition

One aspect of Applicants' invention is a fabric treatment composition that can comprise at least 0.005 wt. %, 0.005 wt. % to 10 wt % or 0.1 wt. % to 2 wt. % of a material such as a perfume, that comprises at least 30 wt. %, 35 wt % to 100 wt. %, 40 wt % to 100 wt. % or 40 wt % to 70 wt. % of a perfume material having a boiling point of less than or equal to 250° C. at 1 atmosphere; a fabric treatment material; an optional carrier and the balance one or more adjunct ingredients.

Examples of suitable perfume materials that have a boiling point of less than or equal to 250° C. at 1 atmosphere, include but are not limited, to: Allyl cyclohexanepropionate, Allyl heptanoate, Allyl caproate, Allo-ocimene, Amyl acetate (n-pentyl acetate), Amyl propionate, Acetanisole, p-Anisaldehyde, Anisole, trans-Anethole, Benzaldehyde (Benezenecarboxaldehyde), Benzylacetate, Benzyl butyrate, Benzyl acetone, Benzyl alcohol, Benzyl formate, Benzyl propionate, Beta-gamma-hexanol (2-hexen-1-ol), (+)-Camphor, Cadinene, Camphene, Carvacrol, Cis-3-hexenyl tiglate, (+)-Carvone, Citronellol, Citronellyl acetate, Citronellyl nitrile, Citronellyl propionate, Cyclohexylethyl acetate, L-Carvone, Cinnamic alcohol, Cinnamyl formate, cis-Jasmone, Cis-3-hexenyl acetate, Citral, Cumic alcohol, Cuminaldehyde, 2,4-dimethyl-3-cyclohexene-1-carboxaldehyde, Dimethyl benzyl carbinol, Dimethyl benzyl carbinyl acetate, Decyl Aldehyde (Capraldehyde), Dihydromyrcenol, Dihydromyrcenyl acetate, 3,7-Dimethyl- -octanol, Diphenyloxide, Ethyl acetate, Ethyl acetoacetate, Ethyl amyl ketone, Ethyl benzoate, Ethyl butanoate, 3-Nonanone (ethyl hexyl ketone), Ethyl phenylacetate, Eucalyptol, Eugenol, Fenchyl alcohol, Fenchyl Acetate (1,3,3-trimethyl-2-norbornanyl acetate), tricyclodecenyl acetate, tricyclodecenyl propionate, Gamma-nonalactone, Geranyl acetate, Geranyl formate, Geranyl nitrile, Trans-Geraniol, cis-3-Hexenyl isobutyrate, Hexyl neopentanoate, Hexyl tiglate, Cis-3-Hexen-1-ol/Leaf alcohol, Hexyl acetate, Hexyl formate, Hydratopic alcohol, Hydroxycitronellal, Alpha-Ionone, Isobornyl acetate, Isobutyl benzoate, Isononyl acetate, Isononyl alcohol (3,5,5-trimethyl-1-hexanol), Isopulegyl acetate, Indole (2,3-benzopyrrole), Isoamyl alcohol, Isopropyl phenylacetate, Isopulegol, Isoquinoline (Benzopyridine), Lauraldehyde, d-Limonene, Linalyl acetate, 2,3-dimethyl-3-cyclohexene-1-carboxaldehyde, Linalool, Linalool oxide, Linalyl formate, Menthone, (−)-L-Menthyl acetate, Methyl Chavicol (Estragole), Methyl n-nonyl acetaldehyde, Methyl octyl acetaldehyde, Beta-Myrcene, 4-Methylacetophenone, Methyl pentyl ketone, Methyl anthranilate, Methyl benzoate, Methyl Phenyl Carbinyl Acetate (alpha-methylbenzyl acetate), Methyl eugenol (eugenol methyl ether), Methyl Heptenone (6-Methyl-5-hepten-2-one), Methyl Heptine Carbonate (methyl 2-octynoate), Methyl heptyl ketone, Methyl hexyl ketone, Methyl salicylate, Dimethyl anthranilate, Neryl acetate, Nonyl acetate, Nonaldehyde, Nerol, Delta-Nonalactone, Gamma-Octalactone, 2-octanol, Octyl aldehyde (caprylic aldehyde), p-Cresol, p-Cymene, Alpha-Pinene, Beta-Pinene, p-Cresyl methyl ether, 2-phenoxyethanol, Phenylacetaldehyde, 2-Phenylethyl acetate, Phenylethyl alcohol, Phenyl ethyl dimethyl carbinol (benzyl-tert-butanol), Prenyl acetate, Propyl butanoate, (+)-Pulegone, methyl iso butenyl tetrahydro pyran, Safrole, 4-terpinenol, Alpha-Terpinene, Gamma-Terpinene, Alpha-Terpinyl acetate, Tetrahydrolinalool, Tetrahydromyrcenol, Terpinolene (alpha-Terpineol), 2-Undecenal, 1,2-dimethoxybenzene, phenylacetaldehyde dimethyl acetal, o-t-butylcyclohexyl acetate, 4-tert-butylcyclohexyl acetate.

In another aspect of Applicants' invention examples of suitable perfume materials that have a boiling point of less than or equal to 250° C. at 1 atmosphere, include but are not limited, to: Allyl caproate, Amyl acetate (n-pentyl acetate), Amyl propionate, p-Anisaldehyde, Anisole, Benzaldehyde (Benezenecarboxaldehyde), Benzylacetate, Benzyl acetone, Benzyl alcohol, Benzyl formate, (+)-Camphor, (+)-Carvone, L-Carvone, Cinnamic alcohol, Cis-3-hexenyl acetate, Citral (Neral), 2,4-dimethyl-3-cyclohexene-1-carboxaldehyde, Dimethyl benzyl carbinol, Dimethyl benzyl carbinyl acetate, Ethyl acetate, Ethyl acetoacetate, Ethyl amyl ketone, Ethyl benzoate, Eucalyptol, Eugenol, Fenchyl alcohol, tricyclodecenyl acetate, tricyclodecenyl propionate, Gamma-nonalactone, Trans-Geraniol, Cis-3-Hexen-1-ol/Leaf alcohol, Hexyl acetate, Hydroxycitronellal, Ligustral (2,3-dimethyl-3-cyclohexene-1-carboxaldehyde), Linalool, Linalool oxide, Linalyl formate, Menthone, 4-Methylacetophenone, Methyl anthranilate, Methyl benzoate, Methyl Phenyl Carbinyl Acetate (alpha-methylbenzyl acetate), Methyl eugenol (eugenol methyl ether), Methyl Heptine Carbonate (methyl 2-octynoate), Methyl heptyl ketone, Methyl hexyl ketone, Methyl salicylate, Dimethyl anthranilate, Nerol, Delta-Nonalactone, Gamma-Octalactone, Octyl aldehyde (caprylic aldehyde), p-Cresyl methyl ether, Phenylacetaldehyde, Phenylethyl alcohol, Phenyl ethyl dimethyl carbinol (benzyl-tert-butanol), Prenyl acetate, methyl iso butenyl tetrahydro pyran, Terpinolene (alpha-Terpineol), Allo-ocimene, Allyl cyclohexanepropionate, Allyl heptanoate, trans-Anethole, Benzyl butyrate, Camphene, Citronellol, Citronellyl acetate, Citronellyl nitrile, Decyl Aldehyde (Capraldehyde), Dihydromyrcenol, Dihydromyrcenyl acetate, 3,7-Dimethyl-1-octanol, Diphenyloxide, Fenchyl Acetate (1,3,3-trimethyl-2-norbornanyl acetate), Geranyl acetate, Geranyl formate, Geranyl nitrile, cis-3-Hexenyl isobutyrate, Alpha-Ionone, Isobornyl acetate, Lauraldehyde, d-Limonene, Linalyl acetate, Methyl Chavicol (Estragole), Methyl n-nonyl acetaldehyde, Methyl octyl acetaldehyde, Beta-Myrcene, Nonaldehyde, p-Cymene, Alpha-Pinene, Beta-Pinene, Alpha-Terpinene, Gamma-Terpinene, Alpha-Terpinyl acetate, Tetrahydrolinalool, Tetrahydromyrcenol, 2-Undecenal, o-t-butylcyclohexyl acetate, 4-tert-butylcyclohexyl acetate.

In another aspect of Applicants' invention examples of suitable perfume materials that have a boiling point of less than or equal to 250° C. at 1 atmosphere, include but are not limited, to: Allyl caproate, Amyl acetate (n-pentyl acetate), Amyl propionate, p-Anisaldehyde, Benzaldehyde (Benezenecarboxaldehyde), Benzylacetate, Benzyl acetone, (+)-Camphor, L-Carvone, Cinnamic alcohol, Cis-3-hexenyl acetate, Citral (Neral), 2,4-dimethyl-3-cyclohexene-1-carboxaldehyde, Dimethyl benzyl carbinyl acetate, Ethyl acetoacetate, Ethyl amyl ketone, Eucalyptol, Eugenol, Fenchyl alcohol, tricyclodecenyl acetate, tricyclodecenyl propionate, Cis-3-Hexen-1-ol/Leaf alcohol, Hexyl acetate, Hydroxycitronellal, 2,3-dimethyl-3-cyclohexene-1-carboxaldehyde, Linalool, Linalool oxide, Linalyl formate, Menthone, Methyl anthranilate, Methyl benzoate, Methyl Phenyl Carbinyl Acetate (alpha-methylbenzyl acetate), Methyl eugenol (eugenol methyl ether), Methyl Heptine Carbonate (methyl 2-ctynoate), Methyl heptyl ketone, Methyl hexyl ketone, Methyl salicylate, Delta-Nonalactone, Octyl aldehyde (caprylic aldehyde), p-Cresyl methyl ether, Phenylethyl alcohol, Prenyl acetate, methyl isao butenyl tetrahydro pyran, Terpinolene (alpha-Terpineol), Allo-ocimene, Allyl cyclohexanepropionate, Camphene, Citronellol, Citronellyl acetate, Citronellyl nitrile, Decyl Aldehyde (Capraldehyde), Dihydromyrcenol, Dihydromyrcenyl acetate, Fenchyl Acetate (1,3,3-trimethyl-2-norbornanyl acetate), Geranyl acetate, Geranyl formate, Geranyl nitrile, Alpha-Ionone, Isobornyl acetate, Lauraldehyde, d-Limonene, Linalyl acetate, Methyl Chavicol (Estragole), Methyl n-nonyl acetaldehyde, Methyl octyl acetaldehyde, Beta-Myrcene, Nonaldehyde, p-Cymene, Alpha-Pinene, Beta-Pinene, Alpha-Terpinene, Gamma-Terpinene, Tetrahydrolinalool, Tetrahydromyrcenol, 2-Undecenal, o-t-butylcyclohexyl acetate, 4-tert-butylcyclohexyl acetate.

The aforementioned perfume materials may be obtained from one or more of the following perfume material suppliers Firmenich (Geneva, Switzerland), Givaudan (Argenteuil, France), IFF (Hazlet, N.J.), Quest (Mount Olive, N.J.), Bedoukian (Danbury, Conn.), Sigma Aldrich (St.Louis, Mo.), Millennium Specialty Chemicals (Olympia Fields, Ill.), Polarone International (Jersey City, N.J.), Fragrance Resources (Keyport, N.J.), and Aroma & Flavor Specialties (Danbury, Conn.).

A treatment material provides one or more fabric benefits including, but not limited to, softness, anti-soil re-deposition, stain or water repellency, color or whiteness enhancement, enhanced absorbency, anti-static, anti-bacterial, or fabric abrasion resistance. Classes of materials that contain materials that can provide such benefits include, but are not limited to, cationic materials, nonionic materials, other polymeric materials, and particulate materials. The compositions of the present invention comprise a treatment material. Typically, said treatment material is present, based on total composition weight, at one of the following levels, at least about 0.5 wt %, at least about 2 wt %, from about 4 wt % to about 90 wt %, from about 4 wt % to about 50 wt %, or from about 4 wt % to about 10 wt %.

Suitable cationic materials include but are not limited to protonatable amines, alkyl quaternary ammonium compounds, cationic silicones, and cationic polymers. Suitable protonatable amines include, protonatable amines having Formula I below:

Formula I wherein the index m=0, 1, 2 or 3; the index n=1, 2, 3 or 4, preferably n is 2 or 3, more preferably n is 2, each R is independently selected from $C_1$-$C_{22}$ alkyl, $C_1$-$C_{22}$ hydroxyalkyl or a benzyl group; each $R^1$ is independently selected from $C_{11}$-$C_{22}$ linear alkyl, $C_{11}$-$C_{22}$ branched alkyl, $C_{11}$-$C_{22}$ linear alkenyl, or $C_{11}$-$C_{22}$ branched alkenyl; and each Q may comprise a carbonyl, carboxyl, or amide moiety.

Suitable alkylated quaternary ammonium compounds (quats), include mono-alkyl quats, di-alkyl, tri-alkyl quats and tetra-alkyl quats and certain cationic surfactants. Suitable mono-alkyl quats, di-alkyl, tri-alkyl quats and tetra-alkyl quats typically have Formula II below:

Formula II

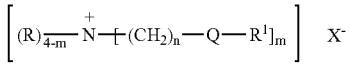

wherein the index m=0, 1, 2, 3 or 4; the index n=1, 2, 3 or 4, preferably n is 2 or 3, more preferably n is 2, each R is independently selected from $C_1$-$C_{22}$ alkyl, $C_1$-$C_{22}$ hydroxyalkyl, or a benzyl group; each $R^1$ is independently selected from $C_{11}$-$C_{22}$ linear alkyl, $C_{11}$-$C_{22}$ branched alkyl, $C_{11}$-$C_{22}$ linear alkenyl, or $C_{11}$-$C_{22}$ branched alkenyl; $X^-$ is a water soluble anionic species such as chloride, bromide or methyl sulfate, and Q may comprise a carbonyl, carboxyl, or amide moiety.

Suitable cationic surfactants include quaternary ammonium surfactants selected from the group consisting of mono $C_6$-$C_{16}$, preferably $C_6$-$C_{10}$ N-alkyl or alkenyl ammonium surfactants, wherein the remaining N positions are substituted by methyl, hydroxyehthyl or hydroxypropyl groups. Another preferred cationic surfactant is $C_6$-$C_{18}$ alkyl or alkenyl ester of an quaternary ammonium alcohol, such as quaternary choline esters. More preferably, the cationic surfactants have Formula III below:

Formula III

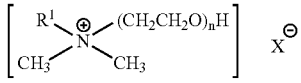

wherein $R^1$ is a $C_8$-$C_{18}$ hydrocarbyl, preferably $C_{8-14}$ alkyl, more preferably $C_8$, $C_{10}$ or $C_{12}$ alkyl, and $X^-$ is a water soluble anionic species such as chloride, bromide or methyl sulfate.

Suitable cationic silicones include silicones functionalized by amine derived compounds and cationic silicone polymers.

Suitable silicones functionalized by amine derived compounds include amino silicones having Formula IV below:

$$(R^1R^2R^3SiO_{1/2})_p(R^4R^4SiO_{2/2})_m[R^4Si(L—NR^5R^6)O_{2/2}]_a[Si(K—NR^7R^8)O_{3/2}]_b[R^4SiO_{3/2}]_c \quad \text{Formula IV}$$

wherein m, a, b, and c are independently selected from integers between 0 and 6000; p=2+b+c; $R^1$, $R^2$, $R^3$, $R^4$, $R^5$, $R^6$, $R^7R^8$, L, K are various side chains attached to the silicone or nitrogen atoms within the molecule. In Formula IV above, $R^1$, $R^2$, $R^3$, $R^4$ are independently selected from:

1.) $C_1$-$C_{22}$ linear or branched, substituted or unsubstituted hydrocarbyl moiety; or 2.) —O—$R^{11}$, —O—$R^{12}$, —O—$R^{13}$, and —O—$R^{14}$, wherein $R^{11}$, $R^{12}$, $R^{13}$, and $R^{14}$ are independently selected from H, or $C_1$-$C_{22}$ linear or branched, substituted or unsubstituted hydrocarbyl moiety.

In Formula IV above, L and K are independently selected from $C_1$-$C_{22}$ linear or branched, substituted or unsubstituted hydrocarbyl moieties. Preferably L and K are independently selected from $C_1$-$C_{12}$ linear or branched, substituted or unsubstituted hydrocarbyl moieties. More preferably L and K are independently selected from $C_1$-$C_4$ linear or branched, substituted or unsubstituted hydrocarbyl moieties. Most preferably L and K are independently selected from methylene, ethylene, propylene, 2-methylpropylene, butylene, octadecylene or 3-(2,2',6,6'-tetramethyl-4-oxy-piperidyl)propyl. In Formula IV above, $R^5$, $R^6$, $R^7$and $R^8$ are independently selected from H, or $C_1$-$C_{22}$ linear or branched substituted or unsubstituted hydrocarbyl moieties.

As used in Formula IV above, "$SiO_{n/2}$" means the ratio of oxygen atoms to silicon atoms, i.e., $SiO_{1/2}$ means one oxygen atom is shared between two silicon atoms.

Suitable cationic silicone polymers include cationic silicone polymers having Formula V below:

$$[CAP]\text{-}Z_m\text{-}[CAP] \quad \text{Formula V}$$

wherein [CAP] is a backbone termination or truncation unit; m is an integer from 1 to 50 and each Z unit has Formula VI below:

$$—(R)_x—W—(R)_x— \quad \text{Formula VI}$$

wherein for Formula VI:

x is 0 or 1;

W is a siloxane unit having Formula VII below:

Formula VII

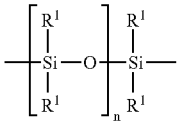

wherein for Formula VII each $R^1$ unit is a $C_1$-$C_{22}$ linear or branched, substituted or unsubstituted hydrocarbyl moiety;

wherein for Formula VI above R has Formula VIII below:

$$—[(L)_y—(R^2)_y—(L)_y]—B—[(L)_y—(R^2)_y—(L)_y] \quad \text{Formula VIII}$$

wherein for Formula VIII above:

y is 0 or 1;

L is a suitable carbon containing linking unit, suitable linking units include, but are not limited to, alkylene moieties, acrylate moieties, and amide containing moieties;

each B is a unit comprising at least one secondary, tertiary, or quaternary amino moiety;

$R^2$ is a coupling unit having the Formula IX below:

Formula IX

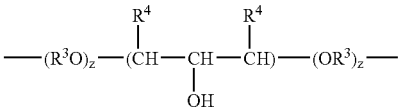

wherein for Formula IX:

each $R^3$ is independently selected from a $C_2$-$C_{12}$ linear or branched alkylene moiety, preferably each $R^3$ is independently ethylene, 1,3-propylene, or 1,2-propylene;

each $R^4$ is independently selected from hydrogen, or a $C_1$-$C_{22}$ linear or branched, substituted or unsubstituted hydrocarbyl moiety, preferably each $R^4$ is independently selected from hydrogen, a $C_1$-$C_{22}$ linear or branched alkyl moiety; a $C_1$-$C_{22}$ cycloalkyl moiety; a $C_1$-$C_{22}$ linear or branched fluoroalkyl moiety; a $C_2$-$C_{22}$ linear or branched alkenyl moiety; a $C_6$-$C_{22}$ aryl moiety; or a $C_7$-$C_{22}$ alkylenearyl moiety; most preferably each $R^4$ is hydrogen, or a $C_1$-$C_{10}$ linear or branched alkyl moiety; and z is an integer from 0 to 50;

Suitable cationic polymers, include copolymers comprising at least one unit, or mixture of units, selected from the group consisting of linear polymer units having Formula X below:

Formula X

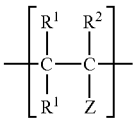

wherein for Formula X, $R^2$ and each $R^1$ are independently hydrogen, hydroxyl, halogen, substituted or unsubstituted hydrocarbon moieties; and Z is a substituted or unsubstituted hydrocarbon moiety containing cationic functional groups;

cyclic units derived from cyclically polymerizing monomers having Formula XI below:

Formula XI

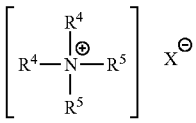

wherein for Formula XI, each $R^4$ is independently an olefin comprising unit which is capable of propagating polymerization in addition to forming a cyclic residue with an adjacent $R^4$ unit; each $R^5$ is independently a $C_1$-$C_{12}$ linear or branched alkyl moiety, or a substituted or unsubstituted benzyl moiety; and $X^-$ is a water soluble anionic species such as chloride, bromide or methyl sulfate.

Suitable nonionic materials include certain surfactants produced by the condensation of alkylene oxide groups with an organic hydrophobic moiety, said moiety can be aliphatic or alkyl aromatic in nature; silicone copolyols; and mixtures thereof. Examples of suitable nonionic surfactants include, but are not limited to alkyl phenol ethoxylates, polyethylene glycol/polypropylene glycol block copolymers, fatty alcohol and fatty acid ethoxylates, long chain tertiary amine oxides, alkyl polysaccharide, polyethylene glycol (PEG) glyceryl fatty esters and mixtures thereof.

Non-limiting examples of suitable silicone copolyols are silicone copolyols having Formula XII below:

$$R^1—(CH_3)_2SiO—[(CH_3)_2SiO]_a—[(CH_3)(R^1)SiO]_b—Si(CH_3)_2—R^1 \quad \text{Formula XII}$$

wherein for Formula XII above, a+b is an integer from 1 to about 50, preferably a+b is an integer from about 3 to about 30, more preferably a+b is an integer from about 10 to about 25; and at least one $R^1$ is a poly(ethyleneoxy/propyleneoxy) copolymer group having Formula XIII below and the remaining $R^1$ moieties are independently selected from the group consisting of methyl and the poly(ethyleneoxide/propyleneoxide) copolymer group having Formula XIII below:

$$—(CH_2)_nO(C_2H_4O)_c(C_3H_{6O})_dR^2 \quad \text{Formula XIII}$$

wherein for Formula XIII above, n is 3 or 4, preferably n is 3; c is an integer from 1 to about 100, preferably c is an integer from about 6 to about 100; d is an integer from 1 to about 14, and preferably d is an integer from 1 to about 3; the total of c+d is an integer of from about 5 to about 150, preferably the total of c+d is an integer from about 9 to about 100; and each $R^2$ is independently selected from the group consisting of hydrogen, an alkyl moiety comprising up to 4 carbon atoms, or an acetyl group.

Suitable polymeric materials include, but are not limited to, polyacrylates, polyvinylalcohols, polyethyleneimines, polysaccharides, polyethyleneglycols, and derivatives or copolymers of the aforementioned materials are suitable for use in the present invention.

Suitable particulate materials include inorganic or organic particulates such as polymeric particles, clays, talcs, zeolites and mixtures thereof Suitable polymeric particles typically have an average particle size less than about 10 microns, preferably less than 5 microns, more preferably less than about 1 micron. Such particles my comprise polyethylene, polystyrene, polypropylene and mixtures thereof. Suitable clay materials include phyllosilicate clays with a 2:1 layer structure, such as smectite clays for example pyrophyllite, montmorillonite, hectorite, saponite and vermiculite, and micas. Particularly suitable clay materials include smectite clays described in U.S. Pat. No. 4,062,647. Other disclosures of suitable clay materials for fabric softening purposes include European patent specification EP 26528-A1, U.S. Pat. No. 3,959,155 and U.S. Pat. No. 3,936,537.

Additional suitable materials include certain synthetic or naturally-derived oils, such as certain triglycerides, mineral oils, and mixtures thereof.

Specific examples of suitable treatment materials include but are not limited to; triglycerides from beef tallow, palm oil, cottonseed oil, canola oil, and soybean oil, all with varying levels of hydrogenation; paraffin oils, and mixtures thereof.

Suitable treatment materials are commercially available from Mazer Chemicals (Gurnee, Ill., USA), Clariant Corporation (Glattbrugg, Switzerland), Rhodia Incorporated (Cranbury, N. J., USA), Scher Chemicals, Inc. (Clifton, N.J., USA), Dow Corning Corporation (Midland, Mich., USA) and General Electric Company (Fairfield, Conn., USA), Witco Corporation (Middlebury, Conn., USA), Degussa-Huls (Marl, Germany), BASF (Mount Olive, N.J., USA), Sigma-Aldrich (St. Louis, Mo., USA), 20 Microns Ltd. (Baroda, India), and Twin Rivers Technologies (Quincy, Mass., USA).

The fabric treatment materials of the present invention may optionally comprise a carrier material. Suitable carrier materials include but are not limited to, water, silicones typically having weight average molecular weights of less than 300 daltons, mono or dialkyl esters, polyols such as glycerine, polyethylene glycols, alcohols, and mixtures thereof.

When the carrier is water, the treatment composition may comprise, based on weight percent of the treatment composition, from about 40 wt. % to about 98 wt. %, from about 50 wt. % to about 95 wt. %, or from about 60 wt. % to about 90 wt. % water. When fabric treatment composition comprises water, the pH of said composition may be in the range of from about 2 to about 10, from about 3 to about 9, from about 4 to about 8, or from about 5.5 to about 7.5.

While not essential for the purposes of the present invention, the non-limiting adjuncts described herein may be desirably incorporated in embodiments of such compositions. The precise nature of such adjunct components, and levels of incorporation thereof, will depend on the physical form of the fabric treatment composition and the nature of the operation for which it is to be used.

Suitable adjunct ingredients include, but are not limited to, salts such as sodium chloride, sodium sulfate, calcium chloride, magnesium sulfate, etc.; preservatives such as benzyl alcohol, methyl paraben, propyl paraben and imidazolidinyl urea; certain thickeners and viscosity modifiers; pH adjusting agents such as citric acid, succinic acid, phosphoric acid, sodium hydroxide, etc.; suspending agents such as magnesium/aluminum silicate; and sequestering agents such as disodium ethylenediamine tetraacetate. Addition examples of suitable adjuncts and levels of use are found in U.S. Pat. No. 6,653,275.

Processes of Making Fabric Treatment Compositions

The fabric treatment compositions of the present invention can be formulated into any suitable form and prepared by any process chosen by the formulator, non-limiting examples of which are described in U.S. Pat. No. 6,653,275.

EXAMPLE

The following compositions are examples of fabric treatment compositions useful in the present invention:

| Component | A | B | C | D | E |
|---|---|---|---|---|---|
| DTDMAC | — | — | — | — | 4.5 |
| DEQA (85% DEQA/15% IPA) | 2.6 | 5.1 | 6.35 | 4.12 | — |
| Fatty acid | — | — | — | 0.2 | — |
| Nonionic | 0.1 | 0.25 | 0.3 | 0.35 | 0.25 |
| Hydrochloride acid | 0.02 | 0.02 | 0.02 | 0.02 | 0.02 |
| *Perfume | 0.10 | 0.15 | 0.21 | 0.28 | 0.25 |

-continued

| Component | A | B | C | D | E |
|---|---|---|---|---|---|
| Silicone antifoam | 0.005 | 0.005 | 0.005 | 0.005 | 0.01 |
| Dye (ppm) | 10 | 10 | 5 | 5 | 10 |

Water and minors to balance to 100%

In the examples, the abbreviated component identifications have the following meanings:

DEQA: Di-(tallowyl-oxy-ethyl)dimethyl ammonium chloride (supplied by Witco Corporation, Middlebury, Conneticut, USA)

DTDMAC: Ditallow dimethylammomium chloride (supplied by Witco Corporation, Middlebury, Conneticut, USA)

Fatty acid: Tallow fatty acid IV = 18 (supplied by Twin Rivers Technologies, Quincy, Massachusetts, USA)

Electrolyte: Calcium chlorided (supplied by Sigma-Aldrich, St. Louis, Missouri, USA)

PEG: Polyethylene Glycol 4000 (supplied by BASF (Mount Olive, New Jersey, USA)

IPA: Isopropyl alchohol (supplied by Sigma-Aldrich, St. Louis, Missouri, USA)

Nonionic: coconut oil derived ethyxylated fatty alcohol (hydrocarbyl chain length 12–14 carbons, ethoxylated chain length, 10–12 ethoxylates) (supplied by Degussa-Huls (Marl, Germany)

*Perfume Composition selected from Perfume Examples A, B or C below:

Perfume Example A

| | |
|---|---|
| Linalool (supplied by Millennium) | 32.00 |
| Citronellol (supplied by Millennium) | 14.00 |
| Cyclohexanemethanol,4-(1-methylethyl)-,cis (supplied by Firmenich) | 7.00 |
| Citronellyl Acetate (supplied by Millennium) | 3.00 |
| Benzyl Acetate (supplied by Quest) | 3.00 |
| P. T. Bucinal (supplied by Givaudan) | 14.00 |
| Indole (supplied by Givaudan) | 1.00 |
| Cumin Oil (supplied by IFF) | 0.25 |
| Methyl Dihydro Jasmonate (supplied by Firmenich) | 6.50 |
| Cis 3 Hexenyl Acetate (supplied by Bedoukian) | 0.50 |
| Hexyl Cinnamic Aldehyde (supplied by Firmenich) | 6.50 |
| Ionone Gamma Methyl (supplied by Givaudan) | 2.00 |
| 2H-Pyran-4-ol,tetrahydro-4-methyl-2-(2methylpropyl) (supplied by Firmenich) | 8.00 |
| Castoreum Synthetic-3c (supplied by Givaudan) | 0.50 |
| Cinnamic Alcohol (supplied by Quest) | 1.75 |

Perfume Example B

| | |
|---|---|
| Amyl Butyrate (supplied by IFF) | 1.20 |
| Dimethyl Benzyl Carbinyl Acetate (supplied by IFF) | 4.50 |
| Ethyl malthol 1% in DPG (supplied by Sigma Aldrich) | 0.50 |
| Ethyl-2-methyl butyrate (supplied by Sigma Aldrich) | 5.00 |
| Ethyl methyl dioxolane acetate (supplied by IFF) | 12.00 |
| 1,3,4,6,7,8-hexahydro-4,6,6,7,8,8-hexamethyl-cyclopenta-gamma-2-benzopyran (supplied by IFF) | 20.00 |
| Hexyl Cinnamic Aldehyde (supplied by Firmenich) | 3.40 |
| Prenyl Acetate (supplied by IFF) | 3.70 |
| 2,3-dimethyl-3-cyclohexene-1-carboxaldehyde (Ligustral) (supplied by IFF) | 0.70 |
| Undecalactone (supplied by Bedoukian) | 10.00 |
| o-t-butylcyclohexyl acetate (supplied by IFF) | 30.00 |

Perfume Example C

| | |
|---|---|
| D-limonene (supplied by Firmenich) | 99.00 |
| Decyl Aldehyde (supplied by Givaudan) | 0.25 |
| Alpha Pinene (supplied by Millennium) | 0.25 |
| Octyl Aldehyde (supplied by Firmenich) | 0.25 |
| Sinensal (supplied by Firmenich) | 0.25 |

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of applying a fabric treatment composition to a fabric article, said method comprising:

a.) monitoring an operating temperature of a drying apparatus during a drying cycle of said drying apparatus;

b.) providing a fabric treatment composition wherein said fabric treatment composition is electrically charged; and c.) spraying said electrically charged fabric treatment composition comprising a perfume and a treatment material onto a fabric article during said drying cycle of said drying apparatus, said spraying application occuring after said drying apparatus has reached a first control operating temperature equal to or higher than about 60° C and after said drying apparatus has reached a second operating temperature of less than about 60° C but befor said drying apparatus has reached a third operating temperature of about 25° C.

2. The method of claim 1 wherein said application occurs after said second operating temperature is reached but before said third operating temperature is reached, said second operating temperature being less than about 50° C and said third operating temperature being greater than or equal to about 30° C.

3. The method of claim 1 wherein said fabric treatment composition comprises a perfume that comprises at least about 30% by weight of a perfume material having a boiling point of less than or equal to 250 ° C at 1 atmosphere.

4. The method of claim 1 wherein said fabric treatment composition comprises a treatment comprising a material selected from the group consisting of protonatable amines, alkyl quaternary ammonium compounds, cationic silicones, and cationic polymers; nonionic surfactants produced by the condensation of alkylene oxide groups with an organic hydrophobic moiety, said moiety can be aliphatic or alkyl aromatic in nature; silicone copolyols; polymeric materials selected from the group consisting of polyacrylates, polyvinylalcohols, polyethyleneimines, polysaccharides, polyethyleneglycols, and derivatives or copolymers of polyacrylates, polyvinylalcohols, polyethyleneimines, polysaccharides, polyethyleneglycols; particulate materials selected from the group consisting of polymeric particles, clays, talcs, zeolites and mixtures thereof; synthetic or naturally-derived oils and mixtures thereof.

5. The method of claim 1 wherein said fabric treatment composition comprises a material that has a flash point of 30 ° C or higher.

6. The method of claim 5 wherein said fabric treatment composition comprises a material that has a flash point of 30 ° C to 400 ° C.

7. The methos of claim 6 wherein said composition comprises a material that has a flash point of about 30 ° C or higher.

8. Amethod of applying a fabric treatment composition to a fabric article, said method comprising:

a.) monitoring an operating temperature of a drying apparatus during a drying cycle of said drying apparatus;

b.) providing a fabric treatment composition wherein said fabric treatment composition is electrically charged; and c.) spraying said electrically charged fabric treatment composition comprising a perfume and a treatment material onto a fabric article during said drying cycle of said drying apparatus, said application occuring after said drying apparatus has reached a first control operating temperature of about 70° C or higher and then returned to a second operating temperature of less than about 70° C but before a third operating temperature of about 20° C is reached.

* * * * *

UNITED STATES PATENT AND TRADEMARK OFFICE

CERTIFICATE OF CORRECTION

PATENT NO. : 7,503,127 B2
APPLICATION NO. : 10/762152
DATED : March 17, 2009
INVENTOR(S) : DuVal et al.

It is certified that error appears in the above-identified patent and that said Letters Patent is hereby corrected as shown below:

On the Title Page Item 63–Related Data
Line 4, delete "Oct. 26" and insert --Oct. 29--.

Column 22
Line 4, after the word Dimethyl, insert a --1-- between the two hyphens.

Column 27
Line 45, after the word thereof, insert a --.--.

Column 29
Line 15, delete "dimethylammomium" and insert --dimethylammonium--.
Line 19, delete "chlorided" and insert --chloride--.
Line 23, delete "alchohol" and insert --alcohol--.

Column 30
Line 29, delete "occuring" and insert --occurring--.
Line 33, delete "befor" and insert --before--.
Line 47, after the word treatment, insert --material--.

Column 32
Line 2, delete "occuring" and insert --occurring--.

Signed and Sealed this

First Day of September, 2009

David J. Kappos

David J. Kappos
*Director of the United States Patent and Trademark Office*